US006168268B1

(12) United States Patent
Sugiyama

(10) Patent No.: US 6,168,268 B1
(45) **Date of Patent: *Jan. 2, 2001**

(54) LIQUID REPLENISHING METHOD AND LIQUID EJECTION RECORDING APPARATUS USING THE SAME METHOD

(75) Inventor: Toshiro Sugiyama, Yokohama (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/172,058

(22) Filed: Oct. 14, 1998

(30) Foreign Application Priority Data

Oct. 20, 1997 (JP) ..... 9-287042
Sep. 16, 1998 (JP) ..... 10-261797

(51) Int. Cl.[7] ..... B41J 2/18

(52) U.S. Cl. ..... 347/89

(58) Field of Search ..... 347/85, 7, 86, 347/89

(56) References Cited

FOREIGN PATENT DOCUMENTS 10-6521 1/1998 (JP) .

*Primary Examiner*—N. Le
*Assistant Examiner*—Michael Nghiem
(74) *Attorney, Agent, or Firm*—Fitzpatrick, Cella, Harper &Scinto

(57) ABSTRACT

A liquid replenishing method into a liquid supply mechanism, the liquid supply mechanism comprising three or more liquid supply paths, each liquid supply path having a sub-tank for temporarily retaining a liquid and for supplying the liquid by guiding the atmosphere thereinto, the liquid replenishing method comprising the steps of preparing a plurality of negative pressure generators, each for replenishing the sub-tank with the liquid, the number of negative pressure generators being smaller than the number of liquid supply paths, and grouping the plurality of liquid supply paths into groups according to the number of negative pressure generators, and establishing a hermetically closed space in a sub-tank with a greatest liquid consumption in each group, and replenishing the liquid while depressurizing the inside of the sub-tank kept as the hermetically closed space, by the negative pressure generator associated with each group.

15 Claims, 22 Drawing Sheets

LIQUID REPLENISHING METHOD AND LIQUID EJECTION RECORDING APPARATUS USING THE SAME METHOD

BACKGROUND OF THE INVENTION

1. Field of the Invention

The present invention relates to a liquid replenishing method in a liquid supplying mechanism capable of supplying a plurality of liquids of different kinds and to a liquid ejection recording apparatus for ejecting the liquids to effect recording by making use of the foregoing method. More particularly, the invention concerns a color ink jet recording apparatus of a type in which ink liquids reserved in main tanks are fed therefrom to be temporarily retained in corresponding sub-tanks, the ink liquids are supplied from the sub-tanks to corresponding printing heads, and a certain ink liquid, when used up in the associated sub-tank, is replenished from the main tank thereof to the sub-tank.

2. Related Background Art

The technology concerning the supply of liquid using liquid supply paths is in practical use in a variety of fields, and an example of the application is an ink jet recording apparatus as a liquid supplying apparatus for ejecting droplets of ink from a recording head to achieve recording on a recording medium.

The ink jet recording apparatus has advantages of capability of recording a high-quality image at high speed but with low noise and capability of readily obtaining a color image, and recently has also been applied as apparatus for recording in large sheet size or in large recording volume, for example, such as a poster output.

Since the ink jet recording apparatus performs recording by ejecting the ink, the ink consumed by ejection always has to be supplied to the recording head. A generally known ink supplying method to the recording head, particularly for apparatus with a large ink consumption, is a method in which a large-volume tank is provided in a form integral with the main body of recording apparatus, an ink flow path is constructed of a pipe such as a tube between the tank and a head cartridge, a mechanism for feeding the ink to the head cartridge is placed in the ink flow path, and this mechanism works to replenish the ink. A specific example of the mechanism for feeding the ink is a mechanism for sending the ink by flattening the tube like a tube pump.

In the ink jet recording apparatus using a large volume of ink as described above there are also demands for downsizing of apparatus and for achieving much higher gradation and quality at high speed.

The method described above, however, for example when adopted in the application using a plurality of recording liquids of different kinds, such as color recording, requires a mechanism for feeding the ink, such as the tube pump, for each color on an independent basis, and there is thus a possibility that the size of the supply units becomes large, particularly in the case of many colors being used, and in turn, the size of the overall recording apparatus becomes large.

In addition, the above-stated method allowed the ink to pass in the mechanisms and it was thus difficult to remove dust etc. with reliability. Particularly, in the application using small apertures of ejection ports for implementing high quality of image, there was a possibility that the dust was deposited in nozzles of the recording head to solidify, so as to cause clogging or the like, and it was thus necessary to provide an extra configuration such as a filter for removing the dust in order to avoid it.

The applicant of the present application filed Japanese Patent Application Laid-open No. 10-6521 to suggest a liquid supplying method and liquid supplying apparatus in which the mechanisms for feeding the ink are provided independent of the ink supply paths, thereby solving the issue about the removal of dust, and facilitating and ensuring the supply of liquid in the liquid supply paths.

The present invention has been accomplished as a result of further intensive and extensive research based on the above suggestion by the present inventor and an object of the invention is to provide a liquid replenishing method for readily and quickly replenishing the liquid to a liquid supplying mechanism provided with plural liquid supply paths.

Another object of the present invention is to provide a liquid ejection recording apparatus that realizes downsizing of the supply unit without the possibility of mixture of dust and that also achieves high-speed recording by shortening ink replenishing time in printing time in a long-term sense.

SUMMARY OF THE INVENTION

For accomplishing the above object, the liquid replenishing method of the present invention is a liquid replenishing method to a liquid supplying mechanism, said liquid supplying mechanism comprising three or more liquid supply paths, each liquid supply path having a sub-tank for temporarily retaining a liquid and for supplying the liquid by guiding the atmosphere thereinto, the liquid replenishing method comprising a step of preparing a plurality of negative pressure generating means, each for replenishing the sub-tank with a liquid, the number of negative pressure generating means being smaller than the number of liquid supply paths, a step of grouping the plurality of liquid supply paths into groups according to the number of negative pressure generating means, a step of establishing a hermetically closed space in a sub-tank with a greatest consumption of the liquid in each group, and a step of replenishing the liquid while depressurizing the inside of the sub-tank kept as the hermetically closed space, by the negative pressure generating means associated with each group.

A liquid ejection recording apparatus of the present invention is a liquid ejection recording apparatus capable of ejecting liquids of mutually different kinds, said liquid ejection recording apparatus having at least three liquid supply paths, each liquid supply path comprising a liquid ejection head for ejecting a liquid to effect recording, a main tank for reserving a liquid to be supplied to the liquid ejection head, and a sub-tank, provided between the liquid ejection head and the main tank, for temporarily retaining the liquid and for supplying the liquid to the head by guiding the atmosphere thereinto, the liquid ejection recording apparatus comprising a plurality of negative pressure generating means, each for depressurizing the inside of the sub-tank in order to replenish the liquid from the main tank to the sub-tank, the number of negative pressure generating means being smaller than the number of liquid supply paths, wherein each of the plurality of liquid supply paths comprises hermetically closing means for establishing a hermetically closed space in the sub-tank, the plurality of liquid supply paths are grouped into groups according to the number of negative pressure generating means, and a sub-tank with a greatest consumption of the liquid in each group is replenished with the liquid by the negative pressure generating means associated therewith.

In the present invention comprising the above, the liquid in each liquid supply path is supplied via a sub-tank to the downstream side. For replenishing the sub-tank with the liquid, the sub-tank is hermetically closed to the atmosphere and is depressurized by use of the negative pressure generating means provided in a path different from the liquid supply path, whereby the liquid is replenished from the upstream side of the liquid supply path into the sub-tank, thus implementing stable replenishment of liquid in spite of the simple structure of the liquid supply path.

In addition, the present invention permits the configuration for selecting a supply path with the greatest liquid consumption in each group, out of the plurality of liquid supply paths grouped corresponding to the negative pressure generating means, and for simultaneously replenishing the selected supply paths with the respective liquids by use of the negative pressure generating means corresponding thereto, thereby implementing efficient replenishment of liquid and decrease in the time necessary for replenishment of liquid.

At this time, particularly, the negative pressure generating means exhaust only the air in the sub-tanks, which can minimize loss in negative pressure generating force of the negative pressure generating means and decrease the replenishing time of liquid. More efficient liquid replenishment can be implemented by detecting liquid amounts in the sub-tanks provided in the respective liquid supply paths and replenishing the liquids when a liquid amount of either one sub-tank falls below a predetermined amount.

When the liquid replenishing method of the present invention is applied to the liquid ejection recording apparatus having the liquid ejection heads at the downstream ends of the liquid supply paths, contamination appearing in the liquid supply paths is decreased and the nozzles of the liquid ejection heads become hard to clog.

The term "hermetically closed" in the present invention means "hermetically closed to the external ambience". The downstream end of each liquid supply path is open to the external ambience in some form, for example in the form of the liquid ejection head, but disconnection from this part can achieve the hermetically closed state in the present invention, even if the sub-tank is connected to the parts.

DESCRIPTION OF THE PREFERRED EMBODIMENTS

Embodiments of the present invention will be described by reference to the drawings.

Figure 1:
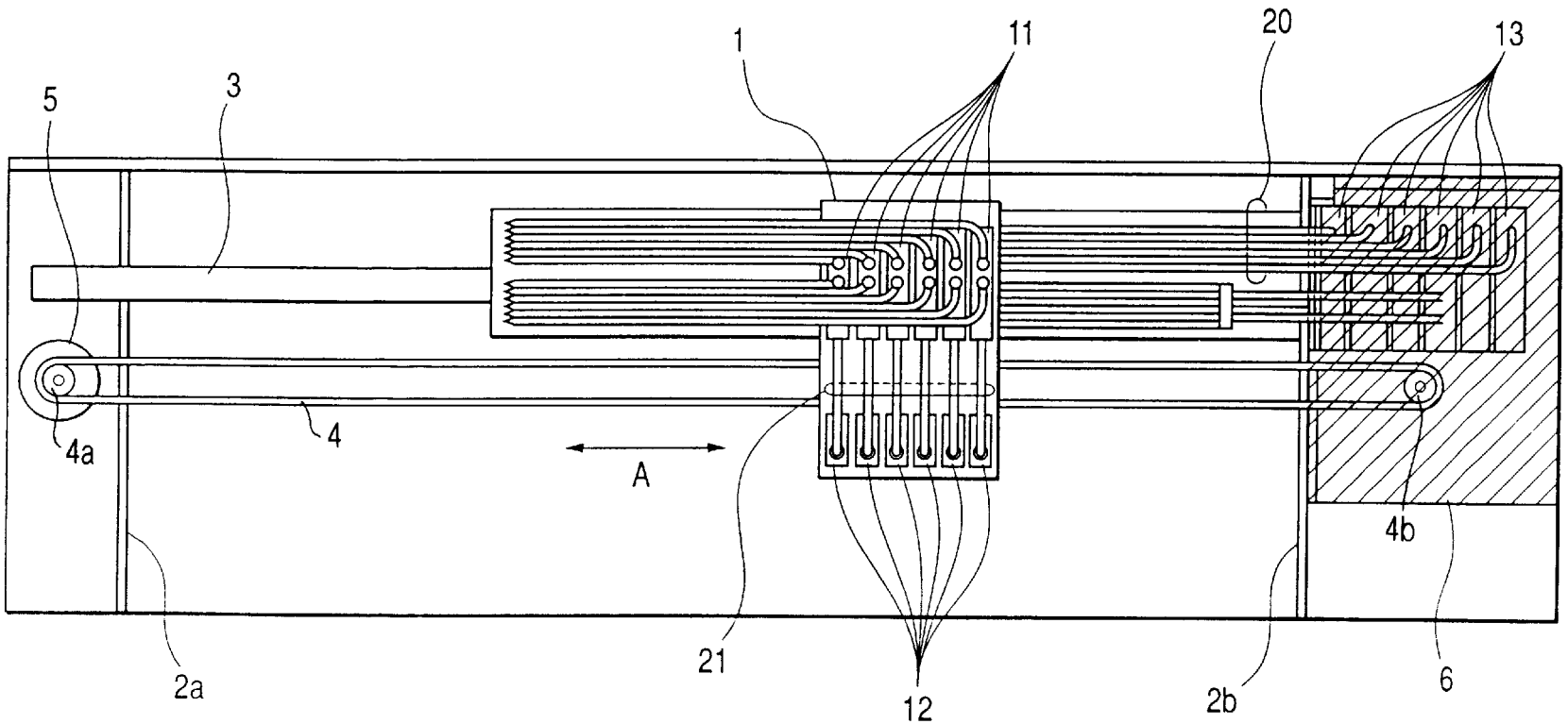
FIG. 1 is a plan view of an embodiment of the ink jet recording apparatus according to the present invention.
Figure 2:
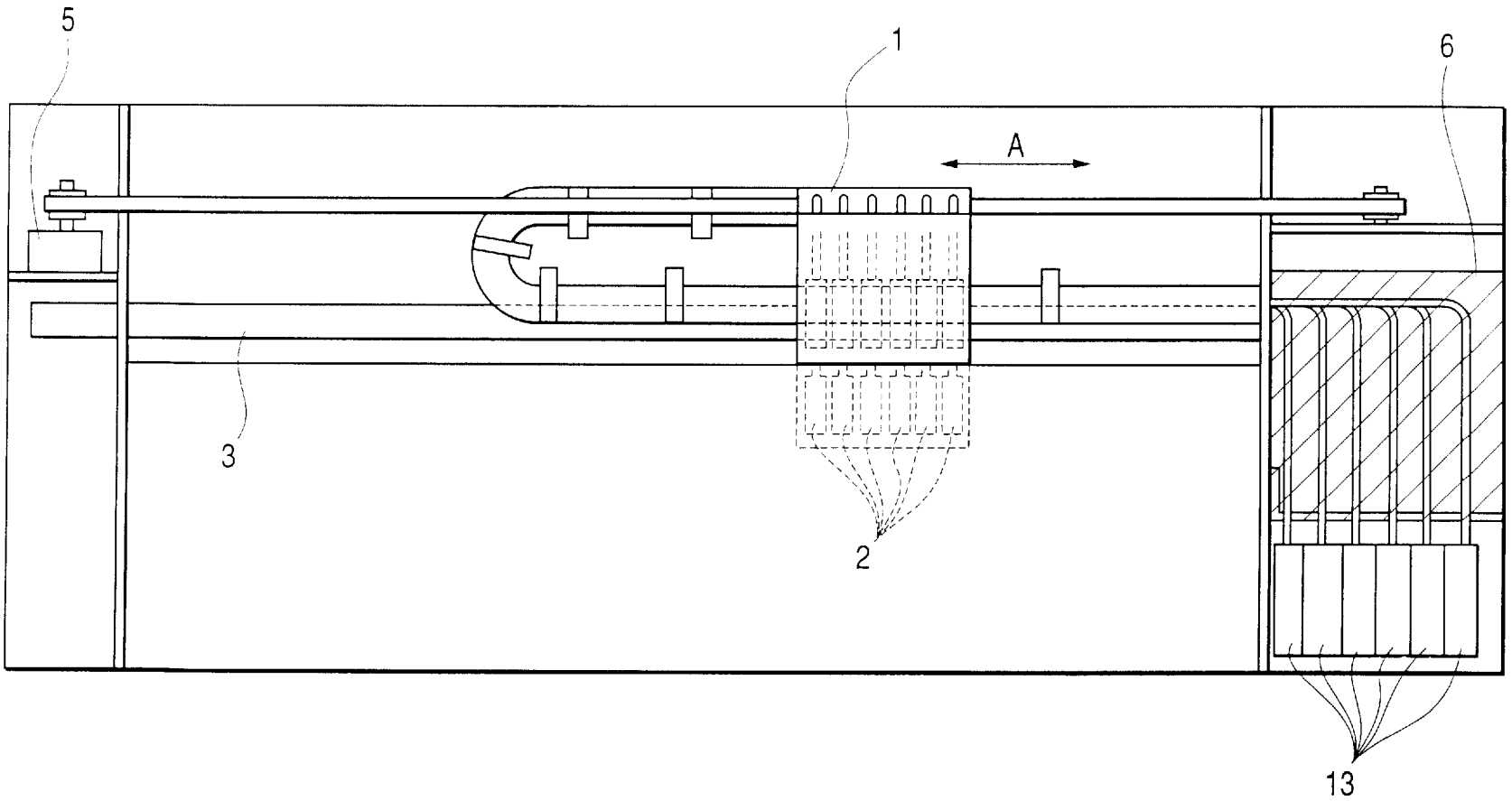
FIG. 2 is a front elevation of the ink jet recording apparatus shown in FIG. 1.

FIG. 1 and FIG. 2 are a plan view and a front elevation, respectively, of an embodiment of the ink jet recording apparatus according to the present invention.

In the ink jet recording apparatus of the present embodiment, a carriage 1 carrying a plurality of printing heads 11 is provided so as to be slidable in directions of arrow A on a guide rail 3 supported by two side plates 2*a*, 2*b*. The carriage 1 is coupled with a part of timing belt 4 stretched between two pulleys 4*a* and 4*b* and the carriage 1 is arranged to reciprocally move in the directions of arrow A by rotating one pulley 4*a* forward and backward by carriage motor 5.

Each printing head 11 has nozzles (not illustrated) for respectively ejecting the ink and heat generating elements (not illustrated) for heating the ink in the nozzles to bring about film boiling of the ink inside the nozzles. When a heat generating element is driven to bring about film boiling of the ink in a corresponding nozzle, a bubble appears in the nozzle and the ink is ejected from the nozzle with growth of the bubble.

A recording medium, which is a print object of the printing heads 11, is conveyed to a position where it faces the nozzles of the printing heads 11, by a recording medium conveying mechanism not illustrated.

A plurality of main tanks 13, the number of which is equal to the number of printing heads 11, are provided in the bottom part of the main body of recording apparatus. These main tanks 13 store respective ink liquids of different colors. The carriage 1 is also equipped with a plurality of sub-tanks 12, the number of which is equal to the number of printing heads 11. Each main tank 13 is connected to an associated sub-tank 12 through a tank tube 20 and each sub-tank 12 is connected to the associated printing head 11 through a head tube 21. Each sub-tank 12 is provided with an ink remainder detecting device (not illustrated) for detecting a residual quantity of the ink retained inside.

In the present embodiment, the numbers of main tanks 13, sub-tanks 12, and printing heads 11 are six and ink liquids of different colors (cyan, magenta, yellow, black, light cyan, and light magenta) are stored therein or supplied thereto.

This ink jet recording apparatus is equipped with a recovery-supply unit 6 having a recovery mechanism for maintaining ejection characteristics of the printing heads 11 and a replenishing mechanism for replenishing the sub-tanks with the respective ink liquids. The recovery-supply unit 6 has the recovery mechanism composed of a cap portion for hermetically closing outlet faces, which are surfaces of apertures of the nozzles of the printing heads 11, wiper blades for wiping the ink outlet faces, and a suction device for forcible suction of the ink in the printing heads. The recovery-supply unit 6 also has the replenishing mechanism composed of negative pressure generators for generating negative pressure in the sub-tanks on the occasion of replenishment of ink into the sub-tanks. The recovery-supply unit 6 also has driving systems for driving these mechanisms etc. (neither of which is illustrated).

Ink lines in the ink jet recording apparatus of the present embodiment will be described referring to FIG. 3. The ink lines are provided for the respective colors. Since all the ink lines are the same, the following describes the ink line of one color.

The tank tube 20 connects the main tank 13 to the sub-tank 12. An end of the tank tube 20 on the side of connection with the sub-tank 12 is put in the sub-tank 12 and a filter for preventing contamination from flowing into the sub-tank 12 is attached to the tip of the tank tube 20. An atmosphere open valve 24, which is driven by a driving source not illustrated, is provided above the sub-tank 12.

The sub-tank 12 is connected at the bottom thereof through the head tube 21 to the printing head 11 and the ink is supplied from the sub-tank 12 to the printing head 11 by the capillarity in the nozzles of the printing head 11. If the position of the printing head 11 were lower than the liquid level of the ink in the sub-tank 12, the ink would leak out of the nozzles of the printing head 11. The printing head 11 is thus located at a position higher than the height of the maximum ink level in the sub-tank 12. Likewise, the main tank 13 is located at a position lower than the height of the minimum ink level in the sub-tank 12 in order to prevent the ink from undesirably being guided from the main tank 13 to the sub-tank 12.

The head tube 21 is provided with a head tube closing valve 25 for closing the ink line between the sub-tank 12 and the printing head 11 by flattening the head tube 21.

The head recovery unit 6 is disposed inside a moving range of the printing head 11 and outside a recording area of the recording medium. A cap 16 of the head recovery unit 6 is arranged to be movable in directions of arrow B and is connected to a waste ink tank 14 through a suction tube 22. The suction tube 22 is provided with a recovery tube pump 18. When the recovery tube pump 18 is driven with the cap 16 capping the printing head 11, the ink inside the printing head 11 is drawn into the cap 16 and is guided through the suction tube 22 into the waste ink tank 14.

A negative pressure tube 23 connects the waste ink tank 14 to the sub-tank 12. The negative pressure tube 23 is connected at the top end of the sub-tank 12 thereto. A negative pressure tube closing valve 26 and a negative pressure generating tube pump 19 are interposed midway of the negative pressure tube 23. The negative pressure generating tube pump 19 is provided in the head recovery unit 6. When the negative pressure generating tube pump 19 is driven with the negative pressure tube closing valve 26 being open, the air in the sub-tank 12 is drawn to be discharged through the negative pressure tube 23 from aperture 14*a* of the waste ink tank 14 to the outside.

The schematic flow of the ink in the ink line illustrated in FIG. 3 will be described below.

The recording operation is carried out by ejecting the ink from the printing head 11 while repeating running of the printing head 11 by reciprocal movement of the carriage 1 and pitch feed of the recording medium with the negative pressure tube closing valve 26 being closed. The ink in the sub-tank 12 is consumed with ejection of the ink from the printing head 11. When the residual quantity of ink becomes little in the sub-tank 12, it is detected by the ink remainder detecting device. With detection thereof, recording on the recording medium is temporarily stopped at that time, and the printing head 11 is moved to the position to face the cap 16. Then the printing head 11 is capped by the cap 16. Subsequently, the head tube closing valve 25 and the atmosphere open valve 24 are closed and the negative pressure tube closing valve 26 is opened, so as to establish a hermetically closed space in the sub-tank 12 in the ink supply line.

The negative pressure generating pump 19 is driven in this state, whereupon the air in the sub-tank 12 is discharged through the negative pressure tube 23 and negative pressure appears in the sub-tank 12. Thus, the sub-tank 12 is kept as a hermetically closed and depressurized space. This causes the ink in the main tank 13 to replenish sub-tank 12 through the tank tube 20.

After the sub-tank 12 is filled with the ink and it is detected by the ink remainder detecting device, the atmosphere open valve 24 is opened to release the sub-tank 12 from the depressurized state, the head tube closing valve 25 is opened, the negative pressure tube closing valve 26 is closed, the negative pressure generating pump 19 is stopped, and thereafter the recording operation is started again.

Since the replenishment of the ink from the main tank 13 to the sub-tank 12 is carried out by generating the negative pressure in the sub-tank 12 and utilizing the negative pressure as described above, there is no need for provision of a mechanism for feeding the ink between the main tank 13 and the sub-tank 12. As a consequence, the structure of the ink supply line becomes simpler and the contamination such as the dust appearing in the ink supply line is also decreased, thus implementing stable ink replenishment.

Although it was described before that the ink lines of the respective colors were of the same structure, it should be noted that the recovery tube pump 18 and the negative pressure generating tube pump 19 are not provided for each of the colors, more precisely. The present embodiment is provided with three recovery tube pumps 18 and two negative pressure generating tube pumps 19 and uses them by switching as occasion may demand.

Figure 4:
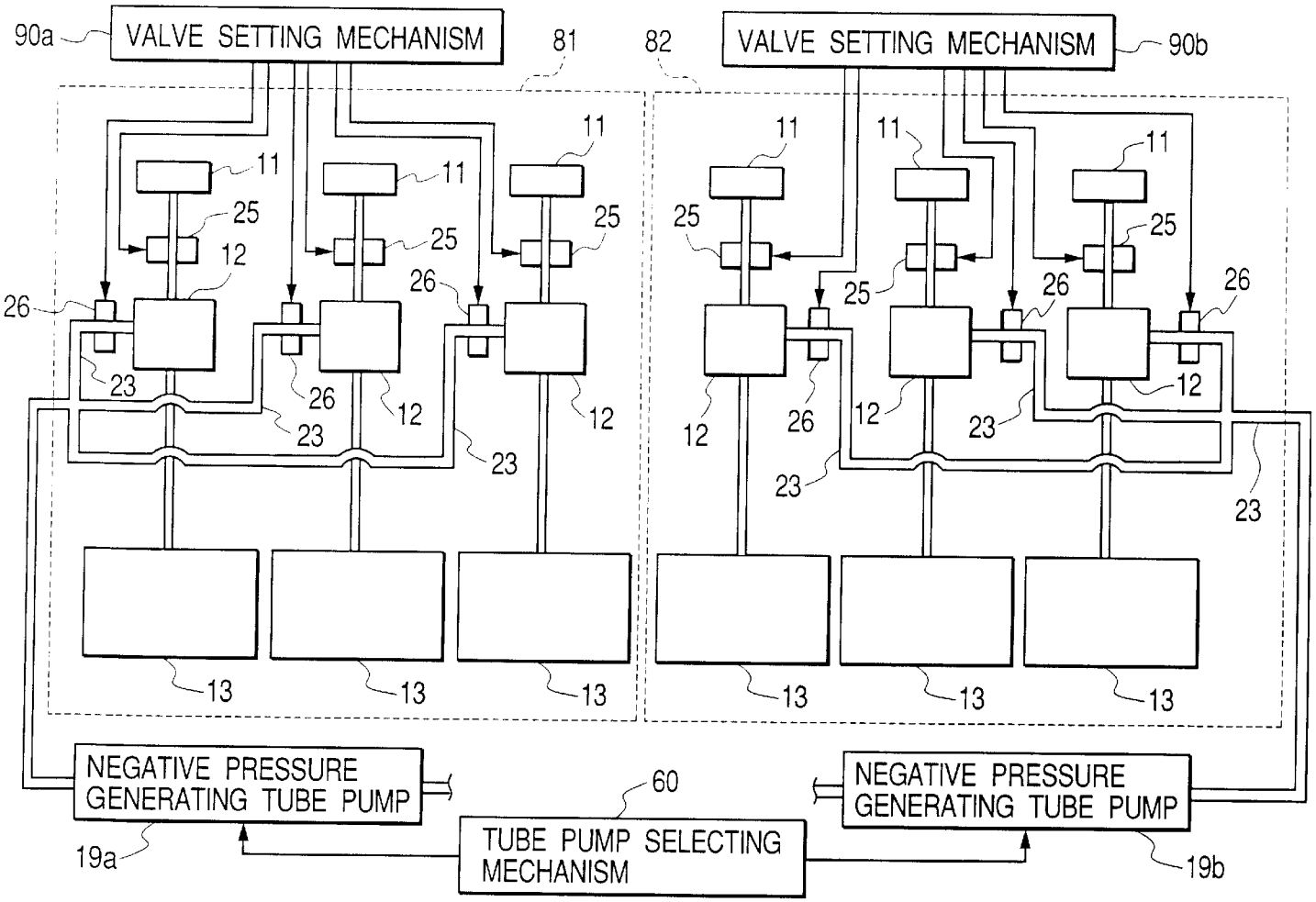
FIG. 4 is a schematic block diagram of the part involved in replenishment of ink to the sub-tanks in the ink jet recording apparatus shown in FIG. 1 and FIG. 2.

The schematic structure of the part involved in the replenishment of ink to the sub-tanks 12 will be described referring to FIG. 4. FIG. 4 is a schematic block diagram of the part involved in the ink replenishment to the sub-tanks in the ink jet recording apparatus of the present embodiment.

As illustrated in FIG. 4, the set of six printing heads 11 and six sub-tanks 12 are grouped into the first group 81 and the second group 82 and one negative pressure generating tube pump 19*a* or 19*b* is assigned to each group. For realizing this configuration, the negative pressure tubes 23 connected to the respective sub-tanks 12 in the first group 81 merge together midway into one to be connected to the negative pressure generating tube pump 19*a,* while the negative pressure tubes 23 connected to the respective sub-tanks 12 in the second group 82 also merge together midway into one to be connected to the negative pressure generating tube pump 19*b*.

Each group is provided with a valve setting mechanism 90*a* or 90*b* for performing open/close operation of the head tube closing valves 25 and negative pressure tube closing valves 26. For replenishing the ink, the head tube closing valve 25 is closed and the negative pressure tube closing valve 26 is opened in either one ink path in each group. Further, the present embodiment is adapted so that each head 11 is provided with a dot counter (not illustrated).

In FIG. 4, reference numeral 60 designates a tube pump selecting mechanism for selection between the negative pressure generating tube pumps and the recovery tube pumps not illustrated in FIG. 4, the pumps sharing a common driving source, the details of which will be described hereinafter. In the case where only one color is always consumed in large volume, the structure of the selecting mechanism is desirably modified so as to be capable of driving only either one of the negative pressure generating tube pumps in the liquid replenishing operation described hereinafter.

The recovery-supply unit 6 will be described in detail.

Figure 5:
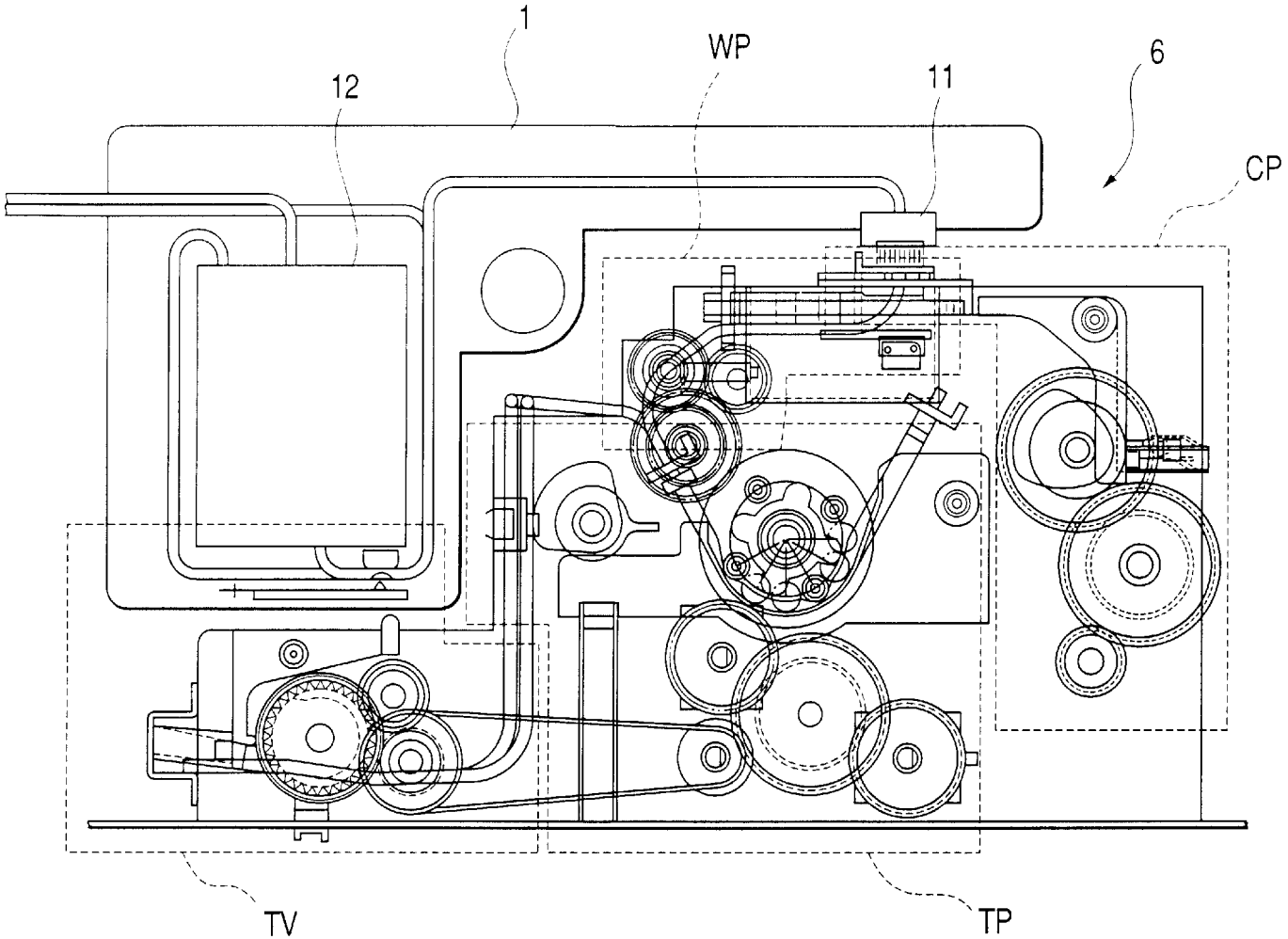
FIG. 5 is a left side view of a recovery-supply unit of the ink jet recording apparatus shown in FIG. 1 and FIG. 2.

FIG. 5 is a left side view of the recovery-supply unit illustrated in FIG. 1. As illustrated in FIG. 5, the recovery-supply unit 6 has a cap mechanism CP for capping the printing heads 11, a tube pump mechanism TP including the aforementioned recovery tube pumps and negative pressure generating tube pumps, a tube valve mechanism TV for driving the tube closing valves, and a wiper mechanism WP for wiping the outlet faces of the printing heads 11.

Figure 6:
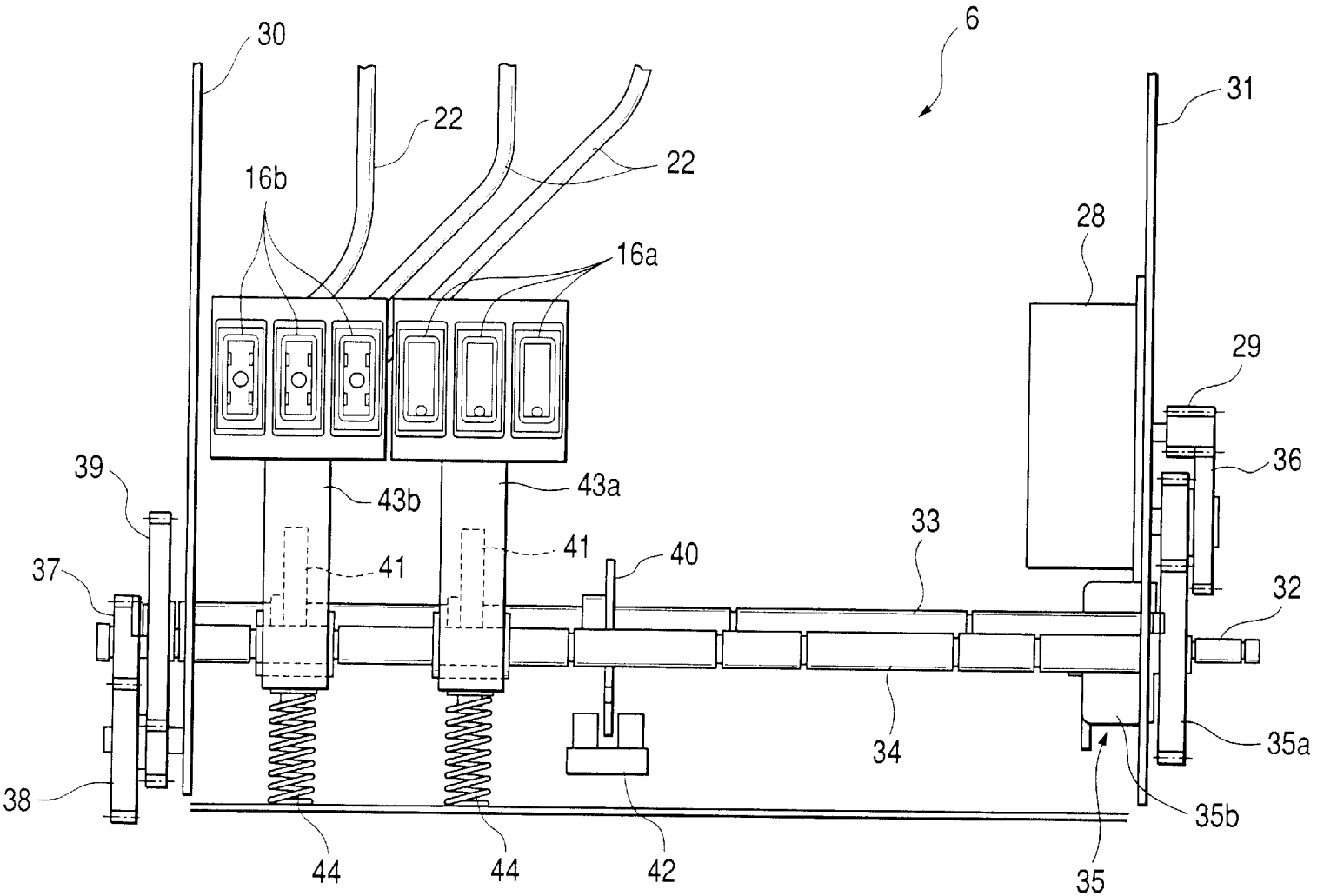
FIG. 6 is a top plan view of a cap mechanism shown in FIG. 5.

First, the cap mechanism CP will be described referring to FIG. 6 and FIG. 7. FIG. 6 is a top plan view of the cap mechanism and FIG. 7 is a right side view of the cap mechanism.

Figure 7:
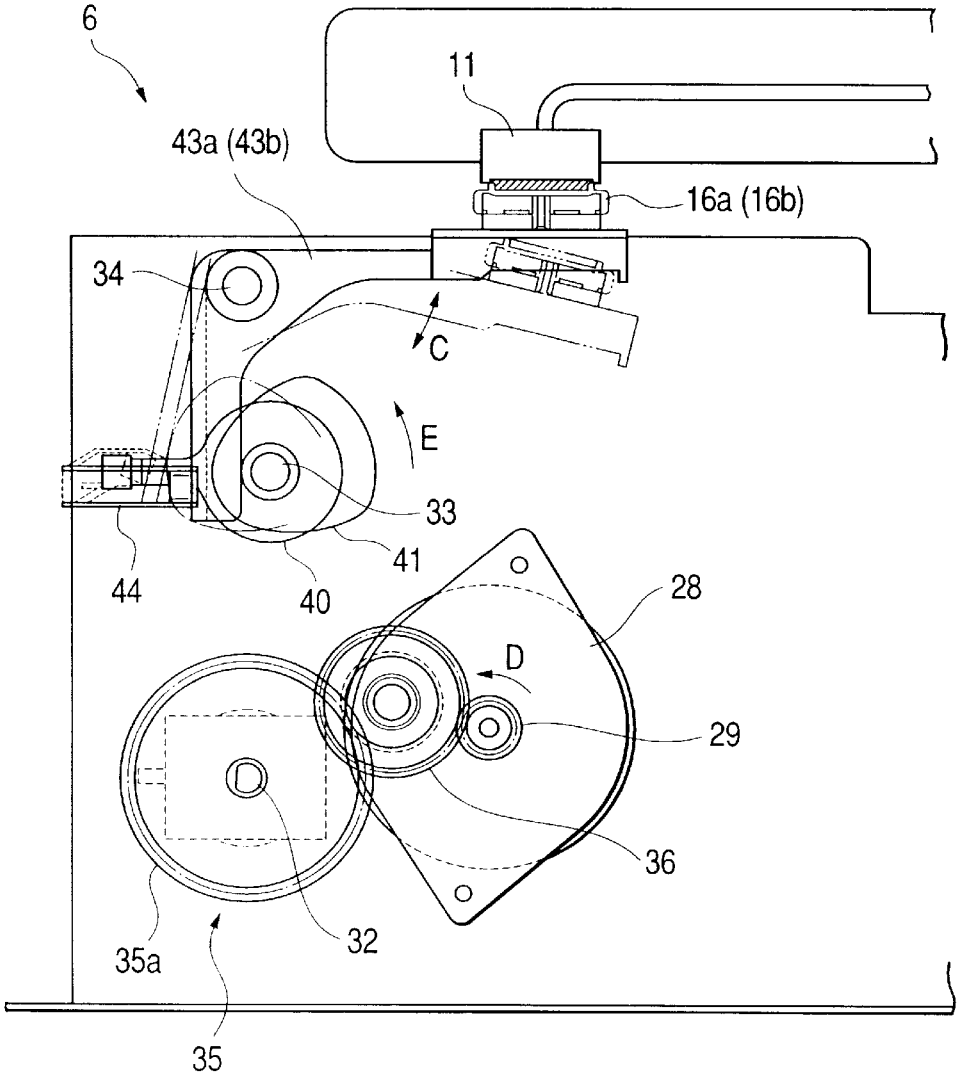
FIG. 7 is a right side view of the cap mechanism shown in FIG. 5.

As illustrated in FIG. 6 and FIG. 7, between left side plate 30 and right side plate 31 of the recovery-supply unit 6, a cap clutch shaft 32 and a cap cam shaft 33 are supported thereby so as to be rotatable, and a cap lever shaft 34 is fixed thereto.

The cap clutch shaft 32 is provided with an electromagnetic clutch 35 for cap, which is fixed to the right side plate 31. The electromagnetic clutch 35 for cap is composed of gear part 35*a* and electromagnetic coil part 35*b*. Rotation of step motor 28 fixed to the right side plate 31 is transmitted to the gear part 35*a* through pinion gear 29 pressed onto a rotational shaft of the step motor 28 and through first cap gears 36 which are double gears rotatably supported on the right side plate 31. When electric current flows in the electromagnetic coil part 35*b,* the rotation of the gear part 35*a* is transmitted to the cap clutch shaft 32; while the current is off, the rotation of the gear part 35*a* is not transmitted to the cap clutch shaft 32.

A second cap gear 37 is fixed to the end of the cap clutch shaft 32 on the left side plate 30 side. The second cap gear 37 is in mesh with fourth cap gear 39 fixed to the end of the cap cam shaft 33 on the left side plate 30 side, through third cap gears 38 which are double gears rotatably supported on the left side plate 30, so that the rotation of the cap clutch shaft 32 is transmitted to the cap cam shaft 33.

Fixed on the cap cam shaft 33 are a sensor flag 40, and two cap cams 41 for respectively swinging two cap levers 43*a,* 43*b* described below. The sensor flag 40 is a platelike member having a projection projecting in a radial direction, and a cap sensor 42 such as a photosensor detects this projection, thereby detecting the phase of the cap cams 41.

A cap lever 43*a* or 43*b* of an L-shape is pivotally arranged opposite to each cap cam 41 on the cap lever shaft 34. Three caps 16*a* or 16*b* are provided at one end of each cap lever 43*a* or 43*b* extending horizontally. The other end of each cap lever 43*a* or 43*b* extending downward is energized toward the cap cam 41 by cap spring 44. In this structure, when the cap cams 41 are rotated with rotation of the cap cam shaft 33, the cap levers 43*a*, 43*b* are pivoted according to the phase thereof in the directions of arrow C illustrated in FIG. 7, thereby effecting capping of the printing heads 11 by the caps 16*a*, 16*b* and release thereof.

The operation of the cap mechanism CP will be described.

First, the electromagnetic clutch 35 for cap is switched on and the step motor 28 is rotated in the direction of arrow D in FIG. 7. The rotation of the step motor 28 is transmitted via the pinion gear 29, first cap gears 36, electromagnetic clutch 35 for cap, cap clutch shaft 32, second cap gear 37, third cap gears 38, and fourth cap gear 39 to the cap cam shaft 33, whereby the cap cams 41 are pivoted in the direction of arrow E of FIG. 7. Since the cap levers 43*a*, 43*b* are urged against the cap cams 41, the rotation of the cap cams 41 causes the cap levers 43*a*, 43*b* to be pivoted about the cap lever shaft 34, whereby the caps 16*a*, 16*b* move up toward the printing heads 11. This pivotal motion continues before the cap sensor 42 detects the projection of the sensor flag 40. Once the cap sensor 42 detects the projection of the sensor flag 40, the step motor 28 is stopped and the electromagnetic clutch 35 for cap is turned off.

Figure 8:
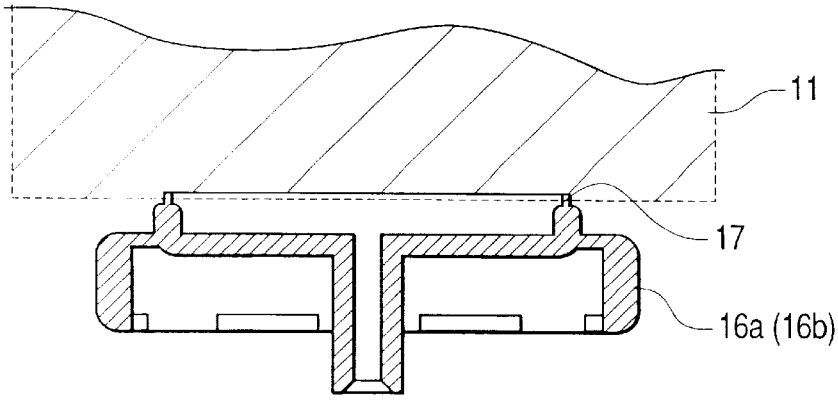
FIG. 8 is an enlarged sectional view of a head cap.

This brings the cap levers 43*a*, 43*b* into the posture illustrated by the solid lines in FIG. 7, thereby achieving capping of the printing heads 11 by the caps 16*a*, 16*b*. At this time, the cap cams 41 are apart from the cap levers 43*a*, 43*b*, and the caps 16*a*, 16*b* push the printing heads 11 by spring force of the cap springs 44. The caps 16*a*, 16*b* are made of an elastic material such as rubber and a rib 17 is formed on a contact surface of each cap with the printing head 11, as illustrated in FIG. 8. When the caps 16*a*, 16*b* are pressed against the printing heads 11, the ribs 17 are crushed flat, so as to hermetically close the ejection outlets (not illustrated) of the printing heads 11.

On the other hand, the releasing operation of the capping by the caps 16*a*, 16*b* is carried out as follows. Like the capping operation described above, the electromagnetic clutch 35 for cap is turned on and the step motor 28 is rotated in the direction of arrow D of FIG. 7, whereupon the cap cams 41 rotate in the direction of arrow E. When the cap cams 41 rotate by a predetermined set value after the cap sensor 42 detects the projection of the sensor flag 40, the step motor 28 is stopped and the electromagnetic clutch 35 for cap is turned off. This set value is preliminarily set to be such a value that the cap cams 41 push the cap levers 43*a*, 43*b* against the energizing force of the cap springs 44 so as to completely depress the caps 16*a,* 16*b* down. In this state, the caps 16*a*, 16*b* are completely withdrawn from the printing heads 11, as illustrated by the chain double-dashed lines in FIG. 7.

There are two cap levers 43*a*, 43*b* provided, but the operation of the levers is the same. A suction tube 22 is connected to each of three caps 16*b* provided in one cap lever 43*b* and these caps 16*b* are used for the recovery operation of the printing heads 11.

Figure 9:
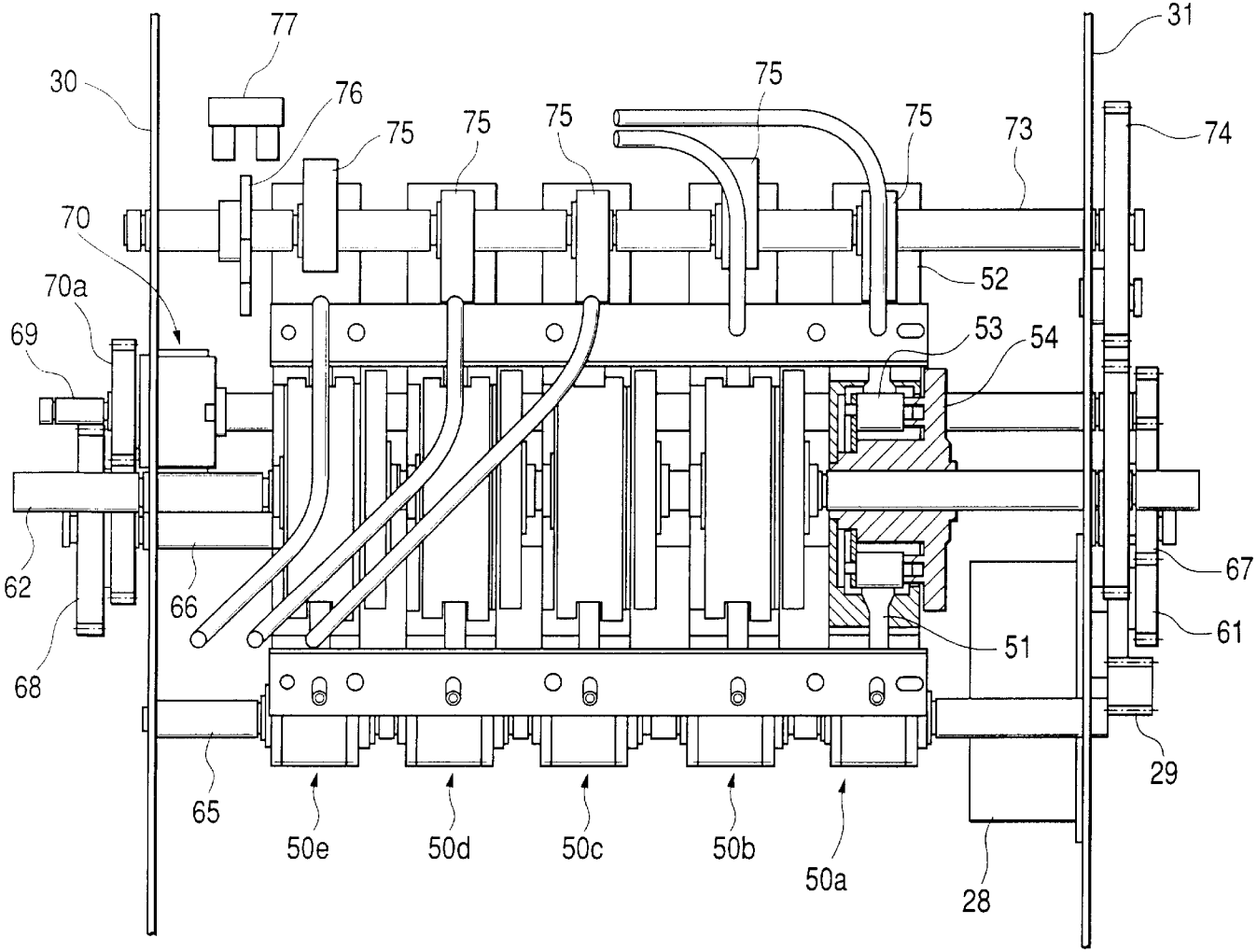
FIG. 9 is a top plan view to show a cross section of a part of a tube pump mechanism shown in FIG. 5.
Figure 10:
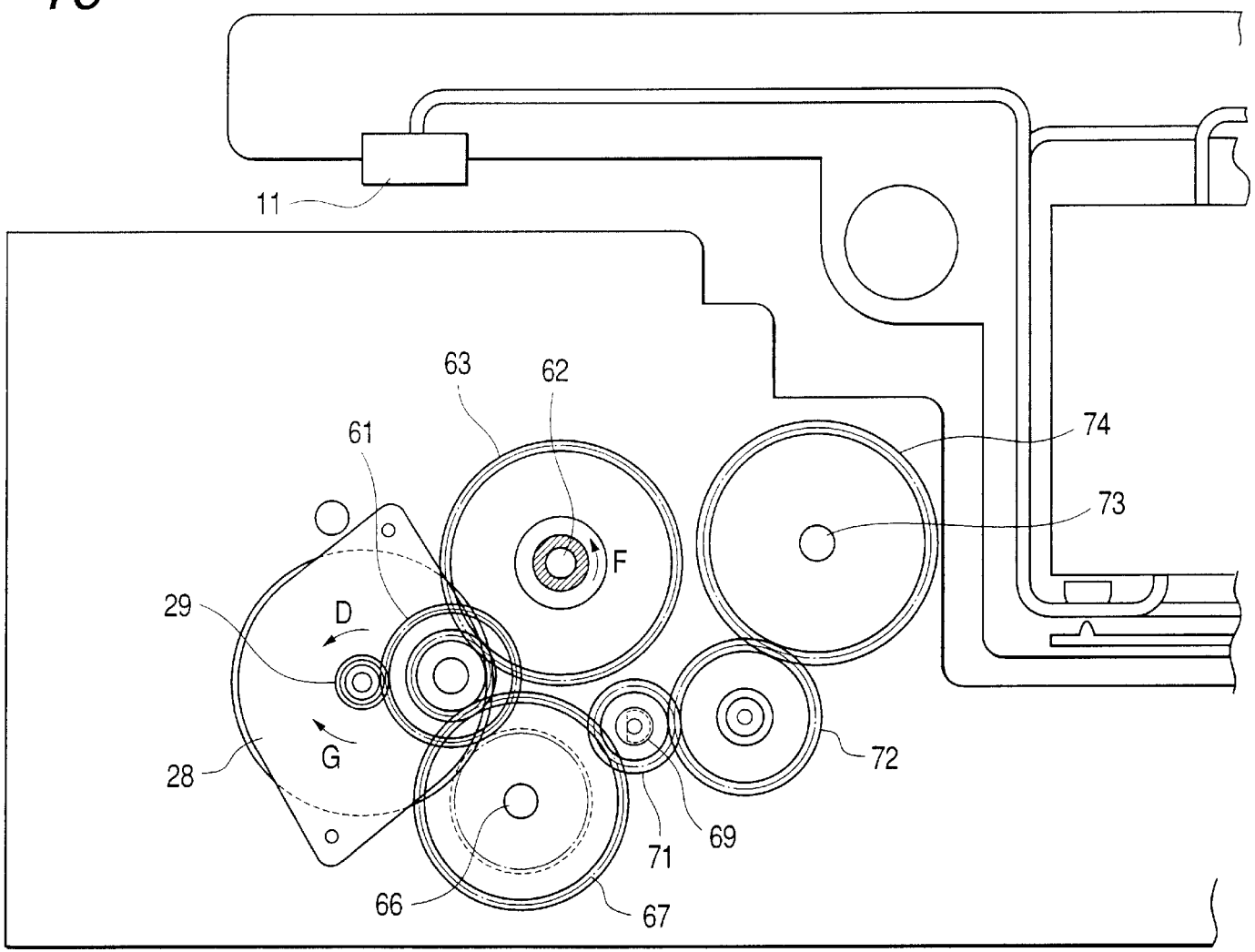
FIG. 10 is a right side view of the tube pump mechanism shown in FIG. 9.
Figure 11:
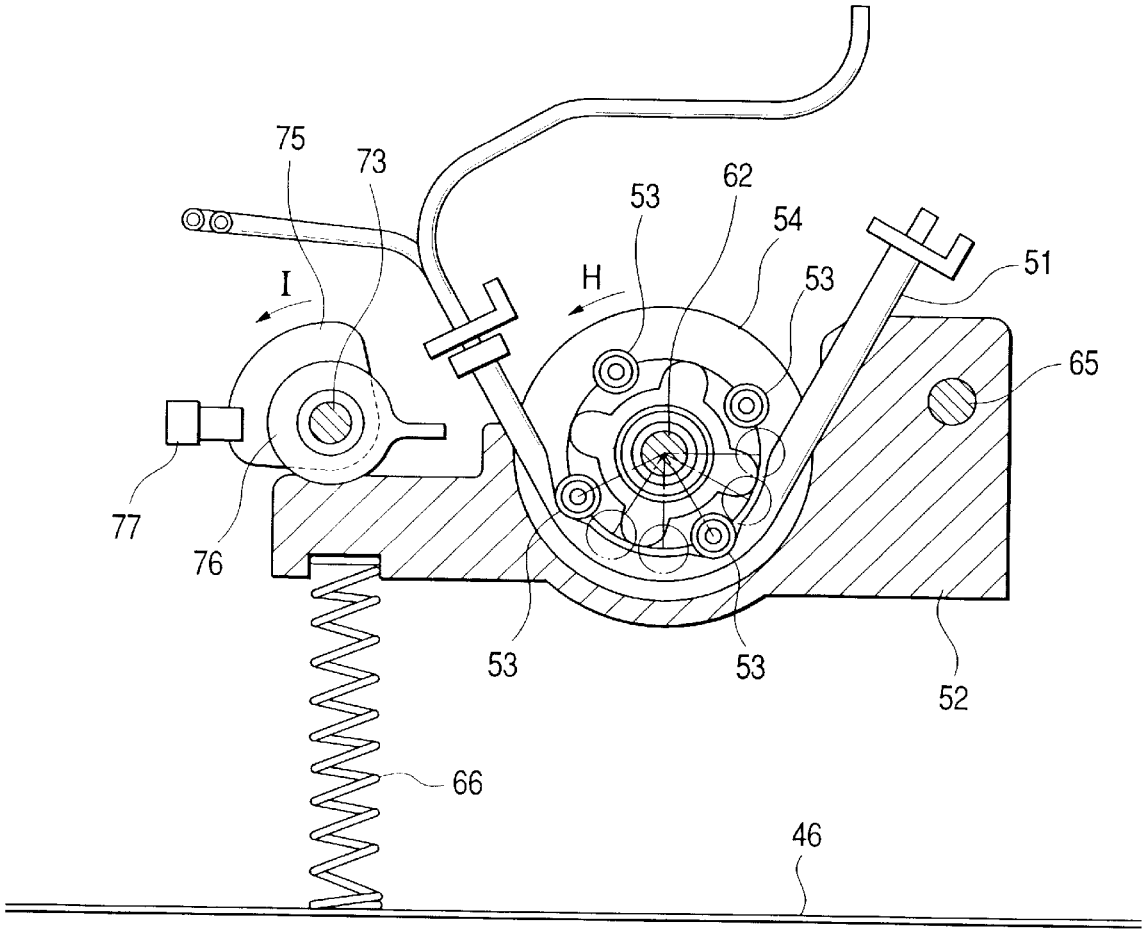
FIG. 11 is a vertical, sectional view of the tube pump shown in FIG. 9.

Next, the tube pump mechanism TP shown in FIG. 5 will be described. FIG. 9 is a top plan view to show a cross section of a part of the tube pump mechanism illustrated in FIG. 5. FIG. 10 is a right side view of the driving mechanism part of the tube pump mechanism shown in FIG. 9 and FIG. 11 is a vertical, sectional view of the tube pump illustrated in FIG. 9.

As illustrated in FIG. 9 and FIG. 10, first pump gears 61, which are double gears rotatably supported on the right side plate 31, are in mesh with the pinion gear 29 pressed onto the rotational shaft of the step motor 28 described above. Between the left side plate 30 and the right side plate 31, a first pump shaft 62 is rotatably supported thereby. Provided on the first pump shaft 62 is a second pump gear 63 in mesh with the first pump gear 61, the second pump gear 63 having a one-way clutch which races in the direction of arrow F of FIG. 10 but bites in the opposite direction to the direction F while the first pump shaft 62 is in a non-rotating state. The rotation of the step motor 28 is transmitted through the first pump gears 61 to the second pump gear 63.

Five tube pumps 50*a*, 50*b*, 50*c*, 50*d*, 50*e* are provided on the first pump shaft 62, as illustrated in FIG. 9. Each tube pump 50*a*–50*e* has a pump tube 51 in which fluid passes, a tube receiver 52 for receiving the tube pump 51, and a roller retainer 54 for retaining rollers 53, which are moved to rotate while flattening the tube pump 51 between the rollers and the tube receiver 52, as illustrated in FIG. 11.

Figure 12:
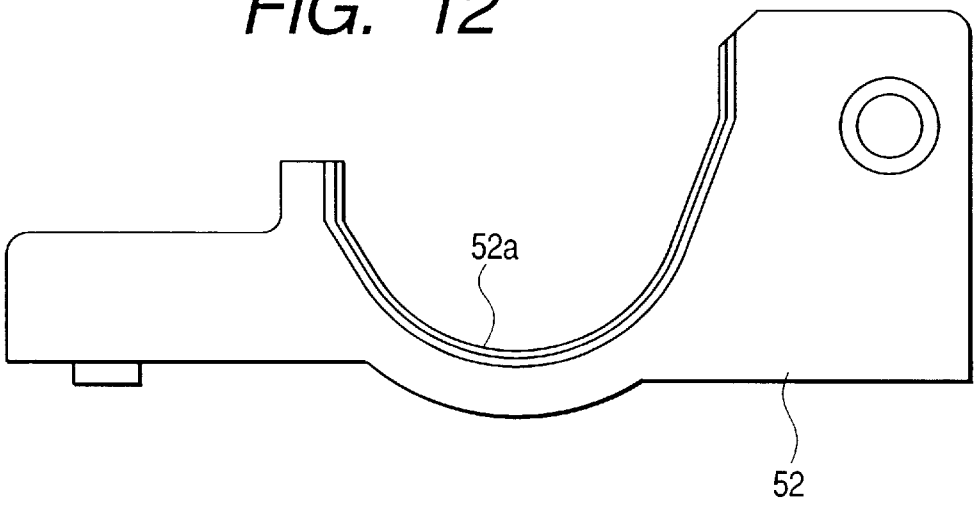
FIG. 12 is a side view of a tube receiver shown in FIG. 11.

The roller retainer 54 is fixed on the first pump shaft 62 and rotatably retains four rollers 53 at equal angular intervals on the same periphery. The tube receiver 52 is pivotally supported on second pump shaft 65 fixed to the left side plate 30 and the right side plate 31, as illustrated in FIG. 9 and FIG. 11, and is energized upward about the second pump shaft 65 by pump spring 66 provided between the tube receiver 52 and base plate 46. The tube receiver 52 has an arcuate recess part 52*a*, as illustrated in FIG. 12, in the portion opposite to the roller retainer 54, and the pump tube 51 is supported on this recess part 52*a*. Since the tube receiver 52 is energized upward by the pump spring 66, the pump tube 51 is held between the tube receiver 52 and the roller retainer 54 in a flattened state between the rollers 53 and the recess part 52*a* of the tube receiver 52.

On the basis of the above structure, when the step motor 28 is rotated in the direction of arrow G of FIG. 10, i.e., in the direction opposite to the rotating direction during the operation of the cap mechanism, the rotation is transmitted via the pinion gear 29 and the first pump gears 61 to the second pump gear 63. The second pump gear 63 has the one-way clutch, and the rotating direction of the second pump gear 63 at this time is the rotating direction in which this one-way clutch acts. Therefore, the rotation of the second pump gear 63 is transmitted to the first pump shaft 62 to rotate each roller retainer 54 in the direction of arrow H of FIG. 11.

With the rotation of each roller retainer 54, the rollers 53 move to rotate on the associated pump tube 51 while flattening the pump tube 51. This squeezes the pump tube 51, so that the fluid in the pump tube 51 is fed in the squeezing direction of the pump tube 51 to generate the negative pressure on the upstream side.

Figure 3:
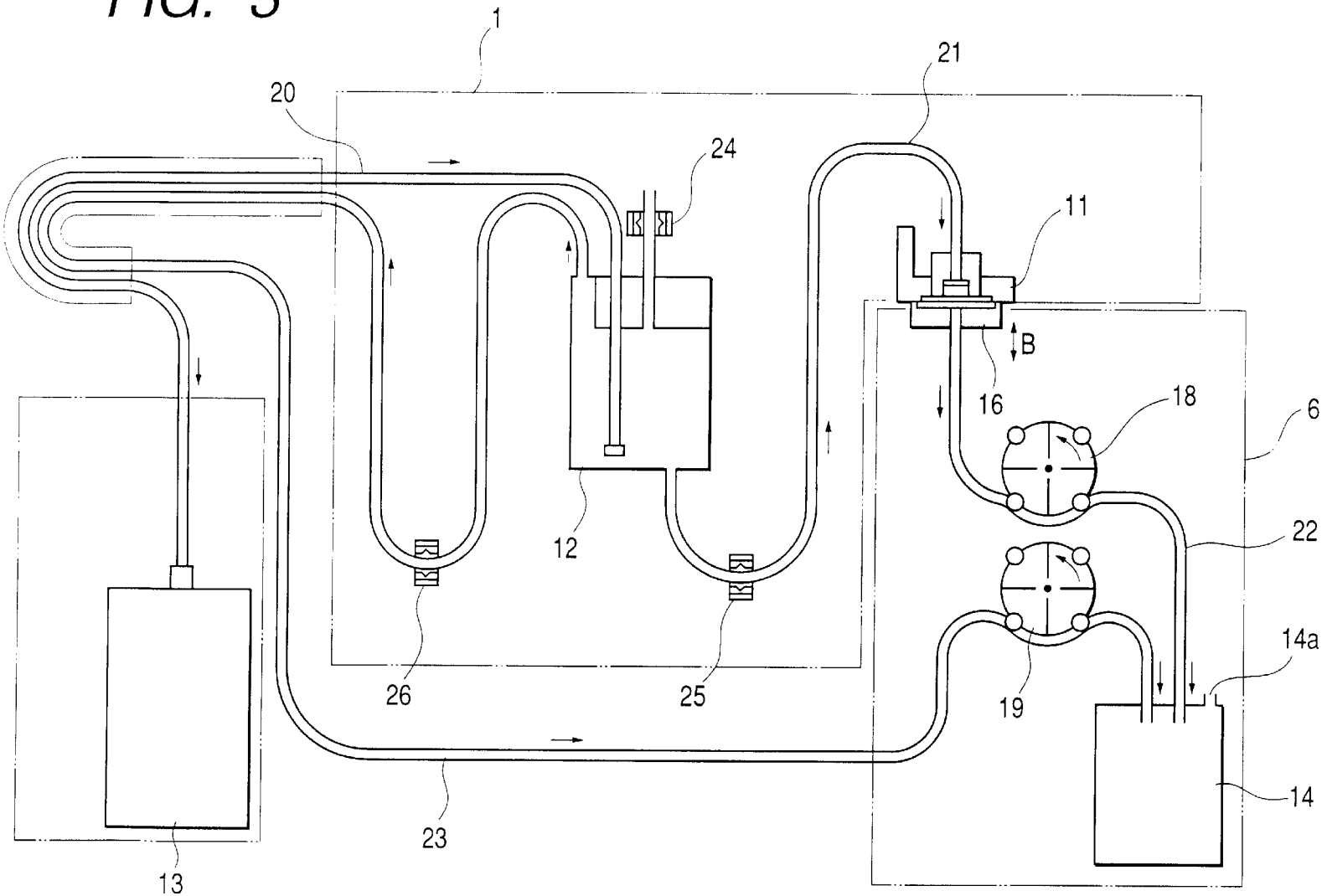
FIG. 3 is a diagram for explaining ink lines in the ink jet recording apparatus shown in FIG. 1 and FIG. 2.

The present embodiment has the five tube pumps 50*a* to 50*e* as described above, among which the three left tube pumps 50*c* to 50*e* in FIG. 9 are used for recovery of the printing heads 11 (see FIG. 3) and the two right tube pumps 50*a*, 50*b* are used for replenishment of ink to the sub-tanks 12 (see FIG. 3). These are switched as occasion may demand.

More specifically, the tube pumps 50*c* to 50*e* function as the recovery tube pumps 18 illustrated in FIG. 3 while the tube pumps 50*a*, 50*b* as the negative pressure generating tube pumps 19 illustrated in FIG. 3. For achieving this, a suction tube 22 (see FIG. 3) is connected through a joint member to the both ends of the pump tube 51 of each recovery tube pump 50*c*–50*e*, and a negative pressure tube 23 (see FIG. 3) is connected through a joint member to the both ends of the pump tube 51 of each pump tube 50*a*, 50*b* for replenishment of ink.

The selecting mechanism of each tube pump (the tube pump selecting mechanism 60 of FIG. 4) will be described referring to FIG. 9 to FIG. 11.

A first intermediate gear 67 in mesh with the first pump gear 61 is fixed to an end on the right side plate 31 side, of a first intermediate shaft 66 rotatably supported by the left side plate 30 and right side plate 31. Second intermediate gears 68, which are double gears, are fixed to the other end of the first intermediate shaft 66 on the left side plate 30 side.

An electromagnetic clutch 70 for selection of pump, having a gear part 70*a* in mesh with the second intermediate gear 68, is provided at an end on the left side plate 30 side, of a pump clutch shaft 69 rotatably supported by the left side plate 30 and the right side plate 31. This electromagnetic clutch 70 for selection of pump has the structure similar to that of the electromagnetic clutch 35 for cap (see FIG. 6) used in the aforementioned cap mechanism. When electric current flows in the electromagnetic clutch 70 for selection of pump, the rotation of the gear part 70*a* is transmitted to the pump clutch shaft 69.

A second pump gear 71 is fixed to the other end of the pump clutch shaft 69 on the right side plate 31 side, and this second pump gear 71 is in mesh with a fourth pump gear 74 fixed to a pump cam shaft 73 rotatably supported by the left side plate 30 and the right side plate 31, through a third pump gear 72. In correspondence to the above tube pumps 50*a*–50*e*, five pump cams 75 are fixed in respective predetermined phases on the pump cam shaft 73. Each pump cam 75 is adapted to rotate together with the pump cam shaft 73 to push the tube receiver 52 and move the tube receiver 52 down against the energizing force of the pump spring 66, thereby releasing the pressing of the rollers 53 against the tube receiver 52.

A sensor flag 76 is fixed to the pump cam shaft 73 like the cap mechanism and the phase of each pump cam 75 can be detected by detecting a projection of this sensor flag 76 by pump sensor 77.

On the basis of the above structure, the electromagnetic clutch 70 for selection of pump is turned on and the step motor 28 is rotated in the direction of arrow D of FIG. 10, whereupon the rotation thereof is transmitted via the pinion gear 29, first pump gears 61, first intermediate gear 67, first intermediate shaft 66, second intermediate gears 68, electromagnetic clutch 70 for selection of pump, pump clutch shaft 69, second pump gear 71, third pump gear 72, and fourth pump gear 74 to the pump cam shaft 73 to rotate the pump cams 75 in the direction of arrow I in FIG. 11. This causes each pump cam 75 to move the tube receiver 52 down, thereby releasing the pressing of the rollers 53 against the tube receiver 52. At this time, the rotation of the first pump gears 61 also rotates the second pump gear 63, but the one-way clutch provided in the second pump gear 63 works so that the rotation of the second pump gear 63 is not transmitted to the first pump shaft 62. Thus the tube pumps 50*a*–50*e* are not driven.

Since each pump cam 75 is set in the predetermined phase with respect to the pump cam shaft 73, either one of the tube pumps 50*a* to 50*e* can be selected arbitrarily by the phase. The selection stated herein means a state in which the tube pump 50*a* to 50*e* can function as a pump, that is, a state in which the pump cam 75 does not act on the tube receiver 52 and the pump tube 51 is flattened between the rollers 53 and the tube receiver 52.

Detection of the phase of the pump cam 75 is similar to that of the phase of the cap cam 41 (see FIG. 7) in the aforementioned cap mechanism. Specifically, control is performed so that the step motor 28 is stopped and the electromagnetic clutch 70 for selection of pump is turned off when a pump cam is rotated by a predetermined set amount after the pump sensor 77 detects the sensor flag 76. This set value is preliminarily set to a value enough for each pump cam 75 to move the tube receiver 52 down so as to release the pressing of the rollers 53 against the pump tube 51, and five points are provided as shown in Table 1 below.

TABLE 1

| Pump selected | Angle of rotation of pump cam |
|---|---|
| Neither pump selected | 0° |
| Pumps a and b (negative pressure pumps) | 90° |
| Pumps c, d, and e (recovery pumps) | 180° |

In Table 1, the pumps a to e represent the tube pumps 50*a* to 50*e* illustrated in FIG. 9.

Since the present embodiment is arranged so that the five tube pumps 50*a* to 50*e* all are driven by the step motor 28 as described above, power saving is achieved even in the case where a plurality of tube pumps are driven at one time. In addition, the selection of the tube pump 50*a* to 50*e* driven can be performed by simply displacing the tube receiver 52 by the cam mechanism described above, so that the selection can be performed readily.

Figure 13:
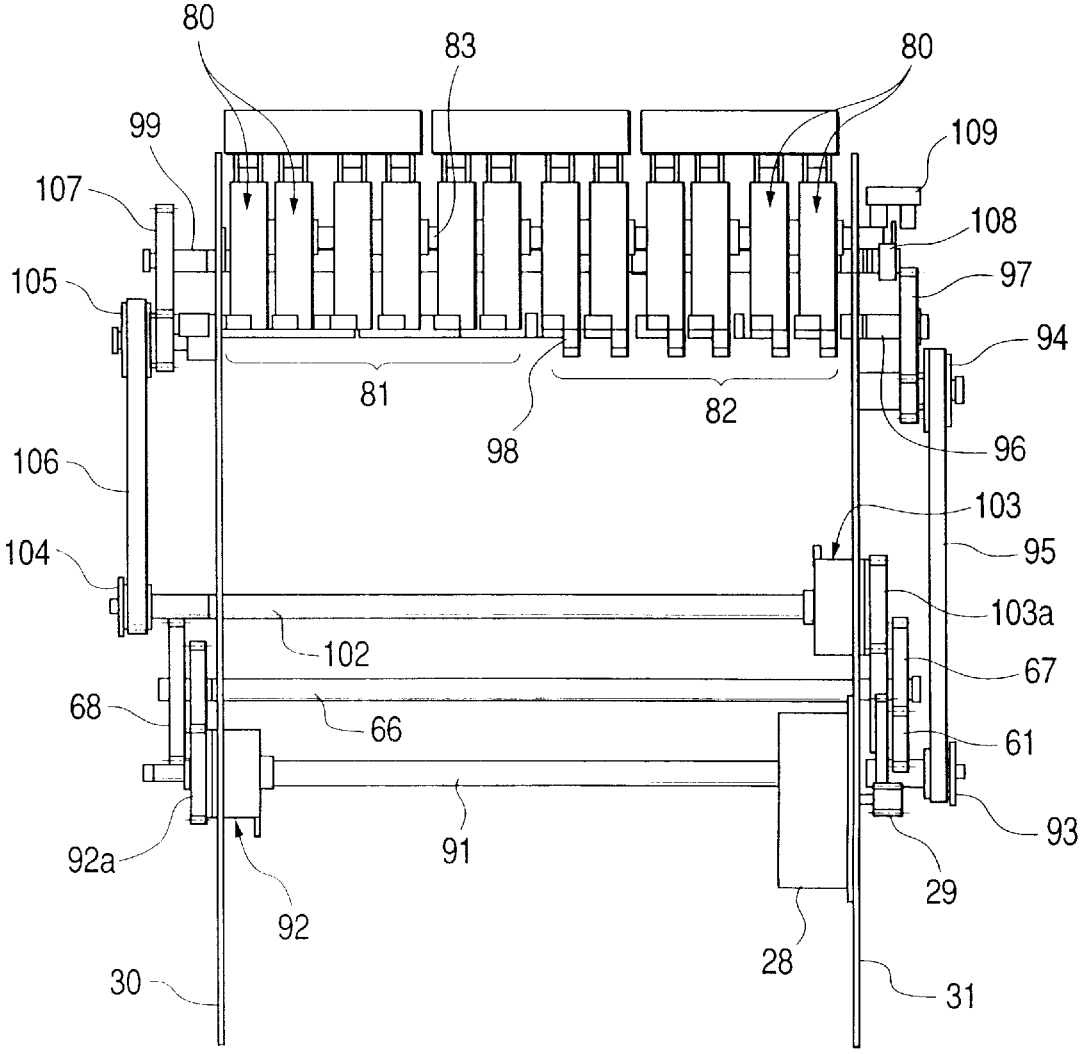
FIG. 13 is a top plan view of a tube valve mechanism shown in FIG. 5.

Next, the tube valve mechanism TV illustrated in FIG. 5 will be described. FIG. 13 is a top plan view of the tube valve mechanism illustrated in FIG. 5.

As illustrated in FIG. 13, the tube valve mechanism has totally twelve tube valves 80 for the six sub-tanks 12 (see FIG. 3), one for hermetically closing the head tube 21 (see FIG. 3) and one for hermetically closing the negative pressure tube 23 (see FIG. 3) per sub-tank. The tube valves 80 are grouped into the first group 81 corresponding to the sub-tanks of cyan, black, and magenta and the second group 82 corresponding to the sub-tanks of light magenta, yellow, and light cyan, and the first group 81 and the second group 82 are driven independently of each other. The first group 81 is driven in correspondence to the operation of the tube pump 50*a* for replenishment (see FIG. 9) and the second group 82 is driven in correspondence to the operation of the tube pump 50*b* for replenishment (see FIG. 9).

There is no substantial difference in the structure of each tube valve 80 itself between the first group 81 and the second group 82. The following describes the structure of the tube valves 80.

Figure 14:
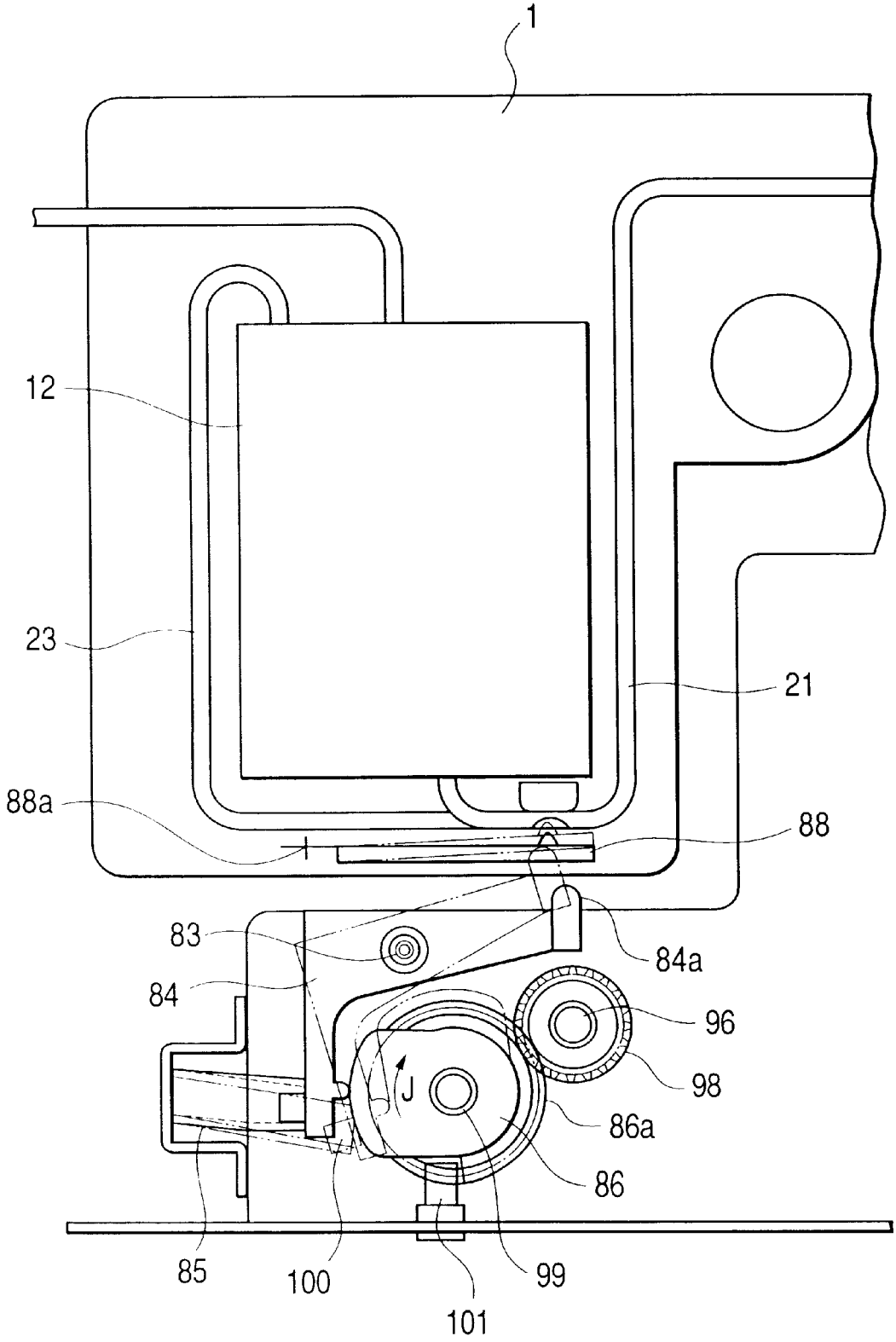
FIG. 14 is a left side view of the part near a tube valve of the second group shown in FIG. 13.
Figure 15:
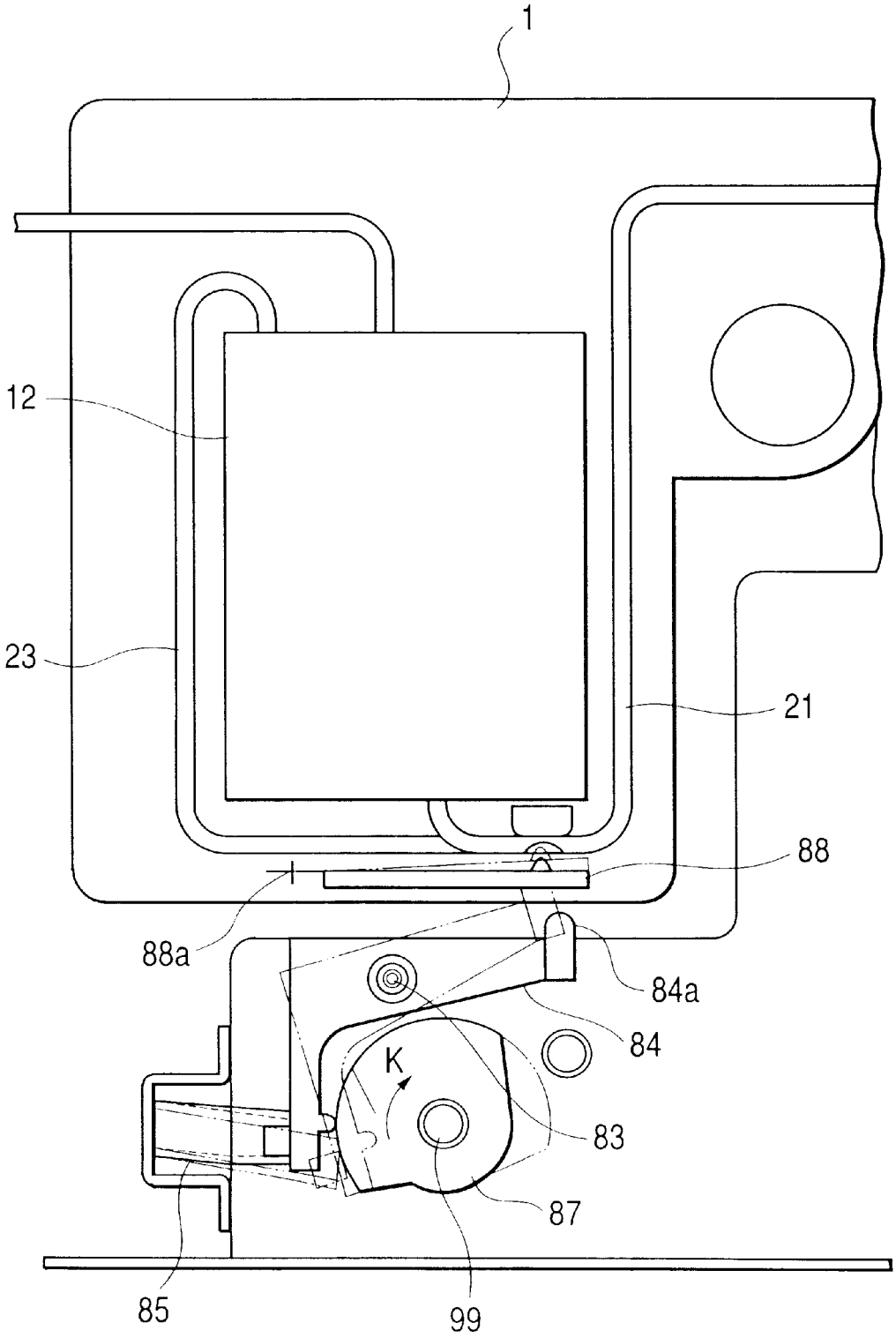
FIG. 15 is a left side view of the part near a tube valve of the first group shown in FIG. 13.

FIG. 14 is a left side view of the part near the tube valves of the second group and FIG. 15 is a left side view of the part near the tube valves of the first group. As illustrated in FIG. 13, a tube valve support shaft 83 is fixed to the left side plate 30 and to the right side plate 31 and twelve tube valve levers 84 forming the respective tube valves 80 are rotatably supported on this tube valve support shaft 83, as illustrated in FIG. 14 and FIG. 15. Each tube valve lever 84 has a horizontal part supported on the tube valve support shaft 83 and a vertical part extending downwardly from one end of the horizontal part.

A projecting part 84*a* projecting toward the carriage 1 is provided at the tip of the horizontal part. The vertical part is energized toward a first-group cam 87 (see FIG. 15) or toward a second-group cam 86 (see FIG. 14), which will be described hereinafter, by a tube valve spring 85. Each tube valve lever 84 is arranged so that the projecting portion 84*a* is moved upward when the tube valve lever 84 is pivoted about the tube valve support shaft 83 by the energizing force of the tube valve spring 85.

On the other hand, a tube pressing member 88 is provided at a position corresponding to each tube valve lever 84, on the carriage 1. Each tube pressing member 88 is a platelike member elastically supported in the cantilever structure at stationary part 88*a* is arranged to flatten the head tube 21 or the negative pressure tube 23 to hermetically close the flow path thereof when the tip part is moved up by the projecting portion 84*a* of the tube valve lever 84. For one sub-tank 12, one set of tube valve lever 84 and tube pressing member 88 function as a head tube closing valve 25 (see FIG. 3), while the other set of tube valve lever 84 and tube pressing member 88 as a negative pressure tube closing valve 26 (see FIG. 3).

Described below is the driving mechanism (the valve setting mechanism 90*b* of FIG. 4) of the second group 82. As illustrated in FIG. 13, a second-group clutch shaft 91 is rotatably supported by the left side plate 30 and the right side plate 31. An electromagnetic clutch 92 for the second group having a gear part 92*a* in mesh with the second intermediate gear 68 described previously is provided on the second-group clutch shaft 91. The second-group electromagnetic clutch 92 has the structure similar to that of the cap electromagnetic clutch 35 (see FIG. 6) described previously, and with flow of electric current the clutch 92 can transmit the rotation of the gear part 92*a* to the second-group clutch shaft 91.

A pulley 93 is fixed to the end of the second-group clutch shaft 91 on the right side plate 31 side. A timing belt 95 is stretched between this pulley 93 and another pulley 94 rotatably supported on the right side plate 31. A gear part of the pulley 94 engages with a second-group first gear 97 fixed on a second-group driving shaft 96 rotatably supported by the left side plate 30 and the right side plate 31.

Six second-group second gears 98 are fixed corresponding to the respective tube valves 80 of the second group 82 on the second-group driving shaft 96. A tube valve cam shaft 99 is rotatably supported by the left side plate 30 and the right side plate 31. As illustrated in FIG. 14, six second-group cams 86 (only one of which is illustrated in FIG. 14), each having a gear part 86*a* in mesh with a second-group second gear 98, are rotatably supported on the tube valve cam shaft 99, and the rotation of each second-group cam 86 acts on the associated tube valve lever 84, thereby operating the tube valve lever 84.

As illustrated in FIG. 14, the second-group cam 86 is provided with a sensor flag 100 having an integral projection, so that the phase of the second-group cam 86 can be detected by detecting the projection of the sensor flag 100 by second-group sensor 101.

On the basis of the above structure, the second-group electromagnetic clutch 92 is turned on and the step motor 28 is rotated in the direction of arrow D illustrated in FIG. 10, whereupon the rotation thereof is transmitted via the pinion gear 29, first pump gears 61, first intermediate gear 67, first intermediate shaft 66, second intermediate gears 68, second-group electromagnetic clutch 92, second-group clutch shaft 91, pulleys 93, 94 and timing belt 95, second-group first gear 97, and second-group driving shaft 96 to the second-group second gears 98, thereby rotating the second-group cams 86 in the direction of arrow J of FIG. 14. This rotation is controlled so as to be stopped when the cams are rotated by a predetermined amount after detection of the sensor flag 100 by the second-group sensor 101.

In this state, a second-group cams 86 is in the posture indicated by the chain double-dashed line in FIG. 14 and is apart from the tube valve lever 84. Therefore, the tube valve lever 84 is pivoted about the tube valve support shaft 83 by the energizing force of the tube valve spring 85, so that the projecting portion 84*a* of the tube valve lever 84 lifts the tip of the tube pressing member 88. This flattens the head tube 21 or the negative pressure tube 23 to close the flow path thereof.

Each second-group cam 86 is in mesh with the second-group second gear 98 with a shift of a predetermined angle in the phase from the other cams. Either one of modes is set as shown in Table 2, depending upon the predetermined rotation set values of the second-group cams 86.

TABLE 2

| | For head tube | | | For negative pressure tube | | | Operating angle of 2nd- |
|---|---|---|---|---|---|---|---|
| Mode | light magenta | yellow | light cyan | light magenta | yellow | light cyan | group cams |
| Replenishment of light magenta | — | o | o | o | — | — | 0° |
| Replenishment of yellow | o | — | o | — | o | — | 90° |
| Replenishment of light cyan | o | o | — | — | — | o | 180° |
| Print | o | o | o | o | o | o | 270° |

In Table 2, "-" represents closing of valve and "O" opening of valve. In this way, states of the tube valve 80 of each ink color, light magenta, yellow, or light cyan, are set depending upon the angles of rotation of the second-group cams.

Next, the driving mechanism of the first group 81 (the valve setting mechanism 90*a* of FIG. 4) will be described. As illustrated in FIG. 13, a first-group clutch shaft 102 is rotatably supported by the left side plate 30 and the right side plate 31. The first-group clutch shaft 102 is provided with an electromagnetic clutch 103 for the first group having a gear part 103*a* in mesh with the first intermediate gear 67 described previously. The first-group electromagnetic clutch 103 has the structure similar to that of the cap electromagnetic clutch 35 (see FIG. 6) described previously and can transmit the rotation of the gear part 103*a* to the first-group clutch shaft 102 with flow of electric current.

A pulley 104 is fixed to the end of the first-group clutch shaft 102 on the left side plate 30 side. A timing belt 106 is stretched between this pulley 104 and another pulley 105 rotatably supported on the left side plate 30. A gear part of the pulley 105 is in mesh with a first-group first gear 107 fixed on the tube valve cam shaft 99.

As illustrated in FIG. 15, six first-group cams 87 (only one of which is illustrated in FIG. 15) are fixed corresponding to the respective tube valves 80 of the first group 81, on the tube valve cam shaft 99. The rotation of each first-group cam 87 acts on the associated tube valve lever 84 of the first group 81, thereby operating the tube valve lever 84. As illustrated in FIG. 13, the tube valve cam shaft 99 is further provided with a sensor flag 108 having an integral projection. The phase of the first-group cam 87 can be detected by detecting the projection of the sensor flag 108 by first-group sensor 109.

On the basis of the above structure, the first-group electromagnetic clutch 103 is turned on and the step motor 28 is rotated in the direction of arrow D illustrated in FIG. 10, whereupon the rotation is transmitted via the pinion gear 29, first pump gears 61, first intermediate gear 67, first-group electromagnetic clutch 103, first-group clutch shaft 102, pulleys 104, 105 and timing belt 106, and first-group first gear 107 to the tube valve cam shaft 99 to rotate the first-group cams 87 in the direction of arrow K of FIG. 15. This rotation is controlled so as to be stopped when the cams are rotated by a predetermined amount after the detection of the sensor flag 108 by the first-group sensor 109.

In this state, a first-group cam 87 is in the posture indicated by the chain double-dashed line in FIG. 15 and is apart from the tube valve lever 84. Accordingly, the tube valve lever 84 is pivoted about the tube valve support shaft 83 by the energizing force of the tube valve spring 85, so that the projecting part 84*a* of the tube valve lever 84 lifts the tip of the tube pressing member 88. This flattens the head tube 21 or the negative pressure tube 23 to close the flow path thereof.

The first-group cams 87 are fixed on the tube valve cam shaft 99 with a shift of a predetermined angle in the phase from the other cams. Either one of modes is set as shown in Table 3, depending upon the predetermined rotation set values of the first-group cams 87.

TABLE 3

| | For head tube | | | For negative pressure tube | | | Operating angle of 1st group |
|---|---|---|---|---|---|---|---|
| Mode | cyan | black | magenta | cyan | black | magenta | cams |
| Replenishment of cyan | — | o | o | o | — | — | 0° |
| Replenishment of black | o | — | o | — | o | — | 90° |
| Replenishment of magenta | o | o | — | — | — | o | 180° |
| Print | o | o | o | o | o | o | 270° |

In Table 3, "–" represents closing of valve, and "O" opening of valve. In this way, states of the tube valve 80 of each ink color, cyan, black, or magenta, are set depending upon the angles of rotation of the first-group cams.

As described above, setting of opening or closing of each flow path of the head tubes 21 and the negative pressure tubes 23 can be effected by simply displacing the tube valve lever 84 by the above-stated cam mechanism so as to flatten or release the head tube 21 or the negative pressure tube 23 through the tube pressing member 88, and thus the setting is easy.

Figure 16:
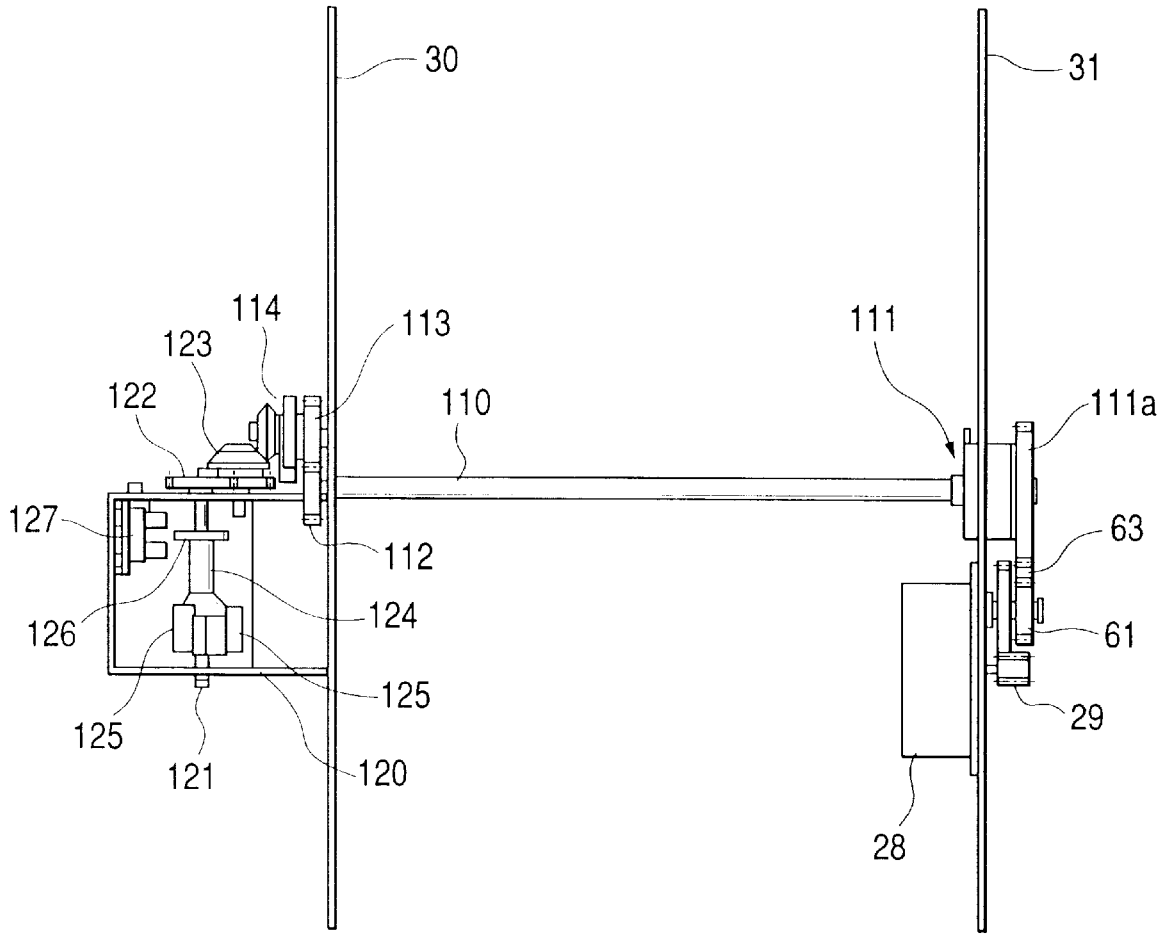
FIG. 16 is a top plan view of a wiper mechanism shown in FIG. 5.
Figure 17:
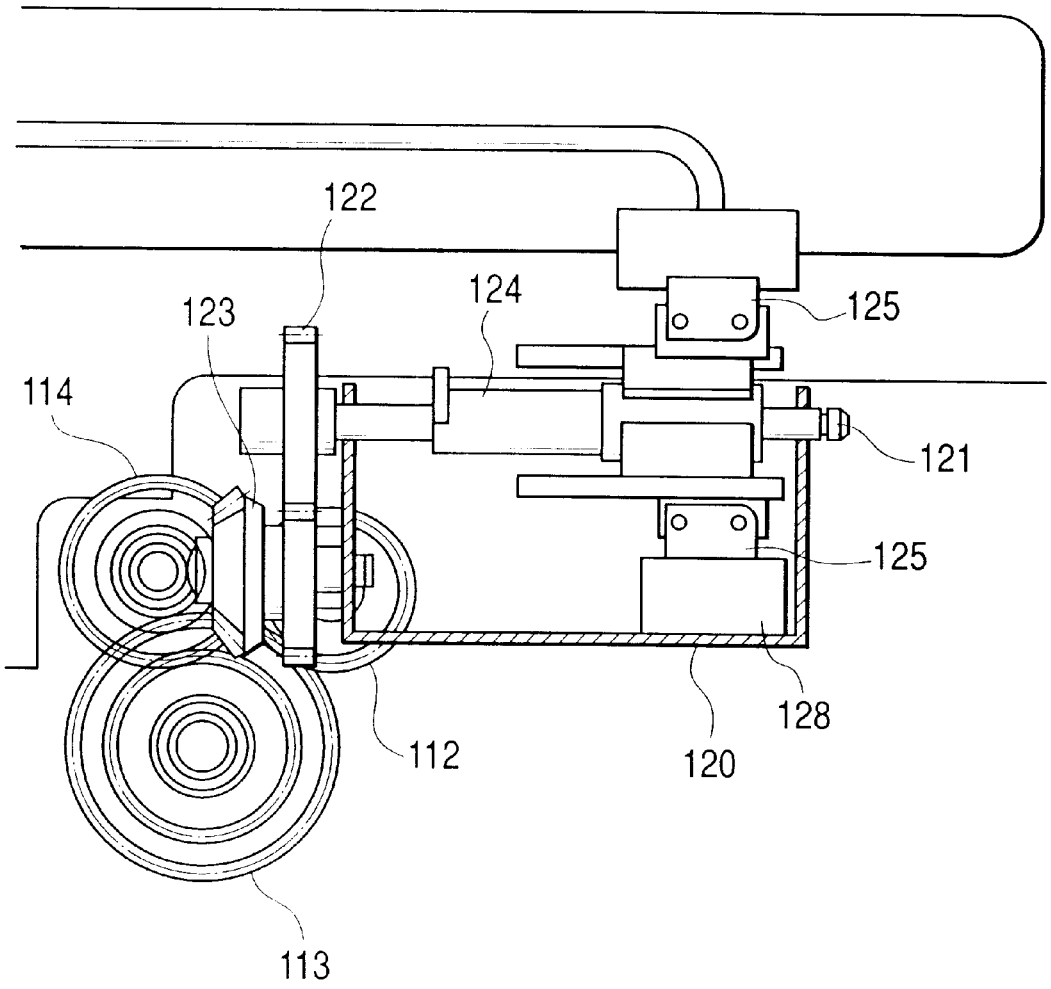
FIG. 17 is a left side view of the wiper mechanism shown in FIG. 16.
Figure 18:
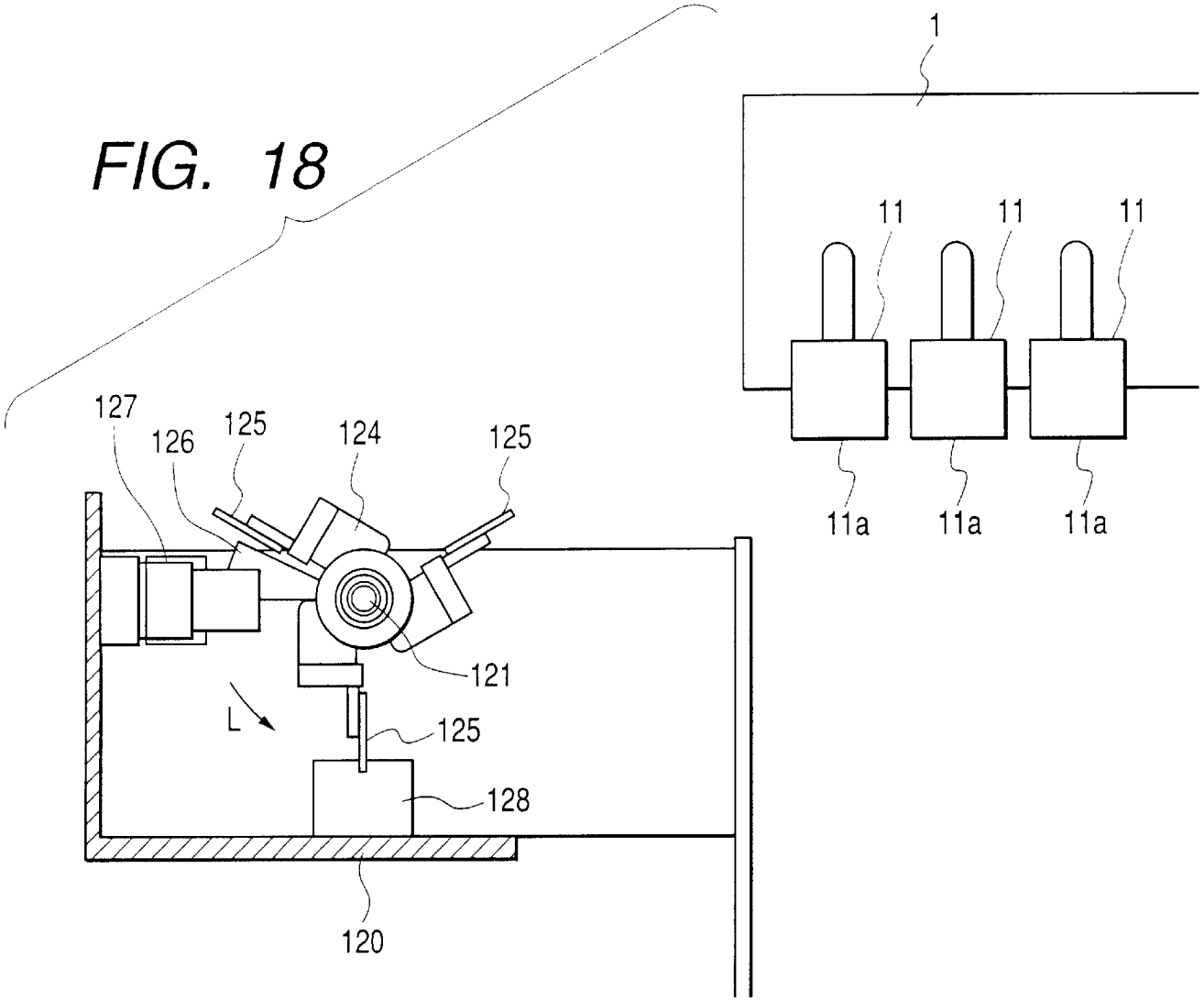
FIG. 18 is a front elevation of a wiper blade part of the wiper mechanism shown in FIG. 16.

Next, the wiper mechanism WP illustrated in FIG. 5 will be described. FIG. 16 is a top plan view of the wiper mechanism illustrated in FIG. 5. FIG. 17 is a left side view of the wiper mechanism illustrated in FIG. 16 and FIG. 18 is a front elevation of the wiper blade part of the wiper mechanism illustrated in FIG. 16.

A wiper clutch shaft 110 is rotatably supported by the left side plate 30 and right side plate 31. The wiper clutch shaft 110 is provided with an electromagnetic clutch 111 for wiper having a gear part 111*a* in mesh with the second pump gear 63 described previously. The wiper electromagnetic clutch 111 has the structure similar to that of the cap electromagnetic clutch 35 (see FIG. 6) described previously, and can transmit the rotation of the gear part 111*a* to the wiper clutch shaft 110 with flow of electric current.

A first wiper gear 112 is fixed to the end of the wiper clutch shaft 110 on the left side plate 30 side. The first wiper gear 112 is in mesh with one of second wiper gears 113, which are double gears rotatably supported on the left side plate 30, and the other gear of the second wiper gears 113 is further in mesh with one of third wiper gears 114, which are double gears rotatably supported on the left side plate 30 as well. The other gear of the third wiper gears 114 is a bevel gear.

On a wiper case 120 fixed to the left side plate 30, fourth wiper gears 123 being double gears are rotatably supported thereby. One of the fourth wiper gears 123 is also a bevel gear, and this bevel gear is in mesh with the bevel gear of the third wiper gears 114. This permits rotation to be transmitted between two shafts perpendicular to each other. A wiper rotation shaft 121 is rotatably supported in the wiper case 120 and a fifth wiper gear 122 fixed on this wiper rotation shaft 121 is in mesh with the other gear of the fourth wiper gears 123.

A wiper blade retainer 124 is fixed on the wiper rotation shaft 121. Three wiper blades 125 are fixed at equal angular intervals with respect to the wiper rotation shaft 121 on the wiper blade retainer 124, as illustrated in FIG. 18. The wiper blades 125 are provided for wiping the outlet faces of the printing heads 11 and are made in a thin plate shape of an elastic material such as rubber. A sensor flag 126 is fixed to the wiper blade retainer 124 and the phase of the wiper blades 125 can be detected by detecting this sensor flag 126 by wiper sensor 127 fixed to the wiper case 120.

A blade cleaner 128 is fixed on the bottom surface of the wiper case 120. The blade cleaner 128 is made of an absorbing material capable of absorbing the ink and is located at a position where the blade cleaner 128 is in contact with the tip part of the wiper blade 125 which is moved to the lowest position by the rotation of the wiper rotation shaft 121.

On the basis of the above structure, the wiper electromagnetic clutch 111 is turned on and the step motor 28 is rotated in the direction of arrow G illustrated in FIG. 10, whereupon the rotation is transmitted via the pinion gear 29, first pump gears 61, second pump gear 63, wiper electromagnetic clutch 111, wiper clutch shaft 110, first wiper gear 112, second wiper gears 113, third wiper gears 114, fourth wiper gears 123, and fifth wiper gear 122 to the wiper rotation shaft 121 to rotate the wiper blades 125 in the direction of arrow L in FIG. 18. Then the step motor 28 is stopped at the position where the wiper sensor 127 detects the sensor flag 126, and the wiper electromagnetic clutch 111 is turned off.

Figure 19A:
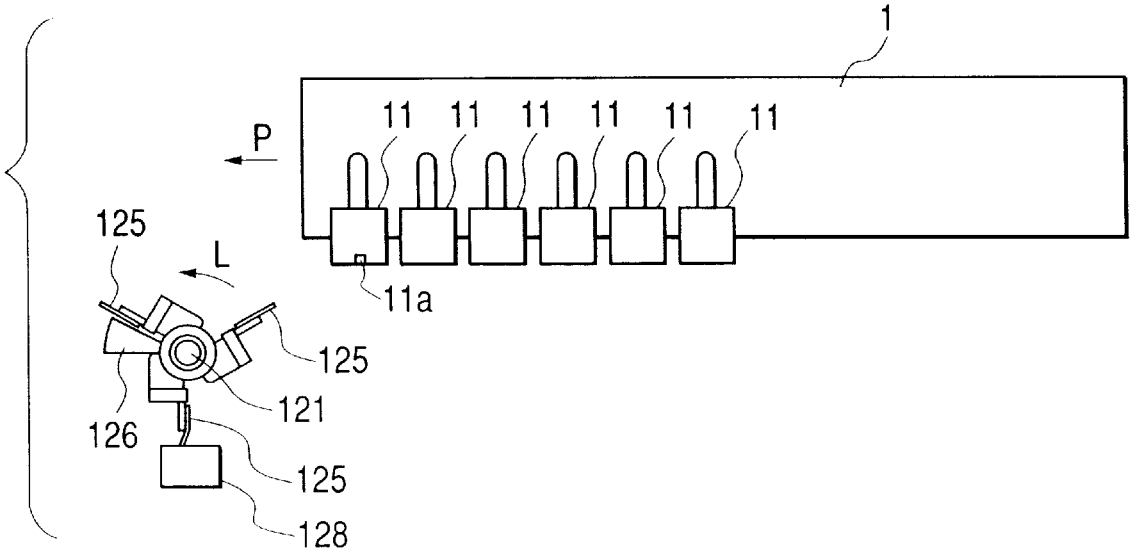
FIG. 19A and FIG. 19B are diagrams for explaining the operation of the wiper mechanism shown in FIG. 16 to FIG. 18.
Figure 19B:
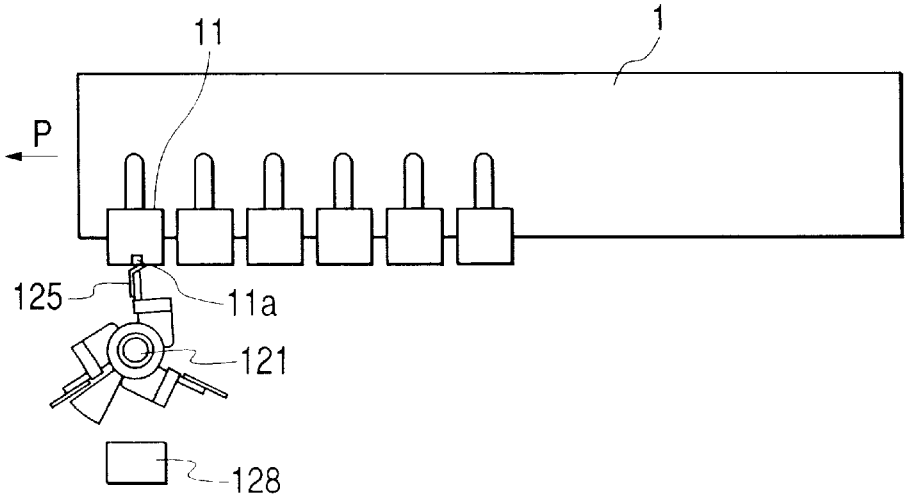

After that, as illustrated in FIGS. 19A and 19B, the carriage 1 is moved at constant speed in the direction of arrow P and, in synchronism therewith, the wiper blades 125 are rotated at constant speed in the direction of arrow L. This causes the wiper blades 125 to wipe the outlet faces 11*a* of the printing heads 11, as illustrated in FIG. 19B.

Here, the moving speed of the carriage 1 and the rotating speed of the wiper blades 125 are so set that during a period after one wiper blade 125 has wiped the outlet face 11*a* of one printing head 11 above the wiper rotation shaft 121 and before the next wiper blade 125 moves to above the wiper rotation shaft 121, the next printing head 11 moves to above the wiper rotation shaft 121. In the present embodiment, one rotation of the wiper rotation shaft 121 is arranged to wipe three printing heads 11 with the different wiper blades 125 and two rotations of the wiper rotation shaft 121 are arranged to wipe all the printing heads 11 accordingly. After wiping a printing head 11, the wiper blade 125 goes into contact with the blade cleaner 128 with rotation of the wiper rotation shaft 121, where the ink etc. attaching to the wiper blade 125 is removed.

When the wiper sensor 127 detects the sensor flag 126, the wiper blades 125 are located so that one wiper blade 125 is in contact with the blade cleaner 128 as illustrated in FIG. 19A. While the wiper operation is not carried out, the wiper blades 125 is kept in the state where the wiper sensor 127 detects the sensor flag 126, so that the wiper blades 125 are kept off contact with the printing heads 11.

The above described the recover-supply unit 6 of the present embodiment, and the ink replenishing operation to the sub-tanks 12 by this recovery-supply unit 6 will be described referring to FIG. 20 and FIGS. 21A and 21B.

Figure 20:
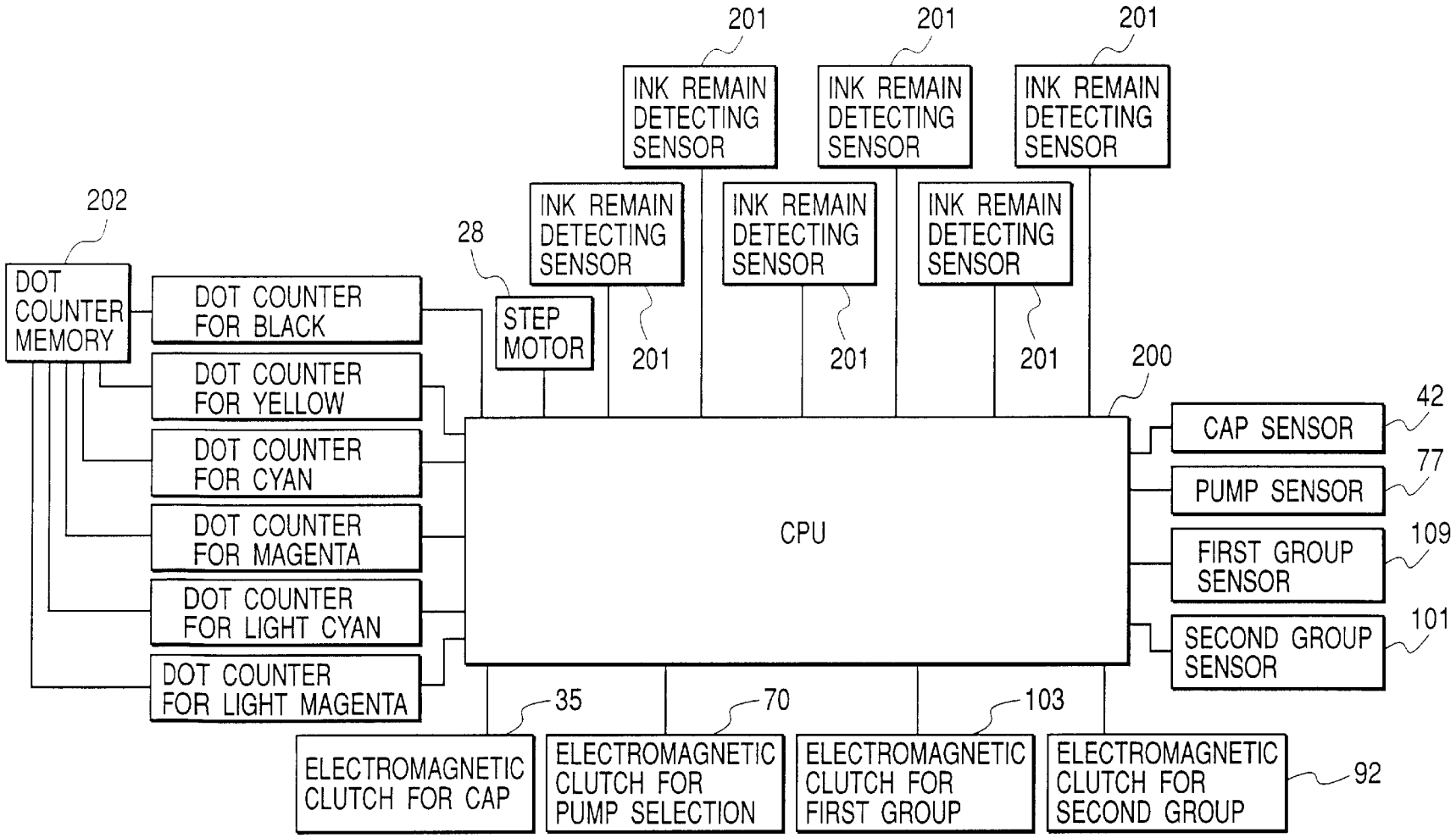
FIG. 20 is a block diagram of the principal part of an electric system in the recovery-supply unit shown in FIG. 5 and other figures.
Figure 21:
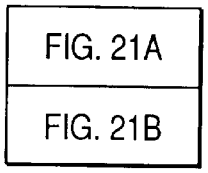
FIG. 21 is composed of FIG. 21A and FIG. 21B showing flowcharts of the replenishment operation of ink into the sub-tanks.
Figure 21A:
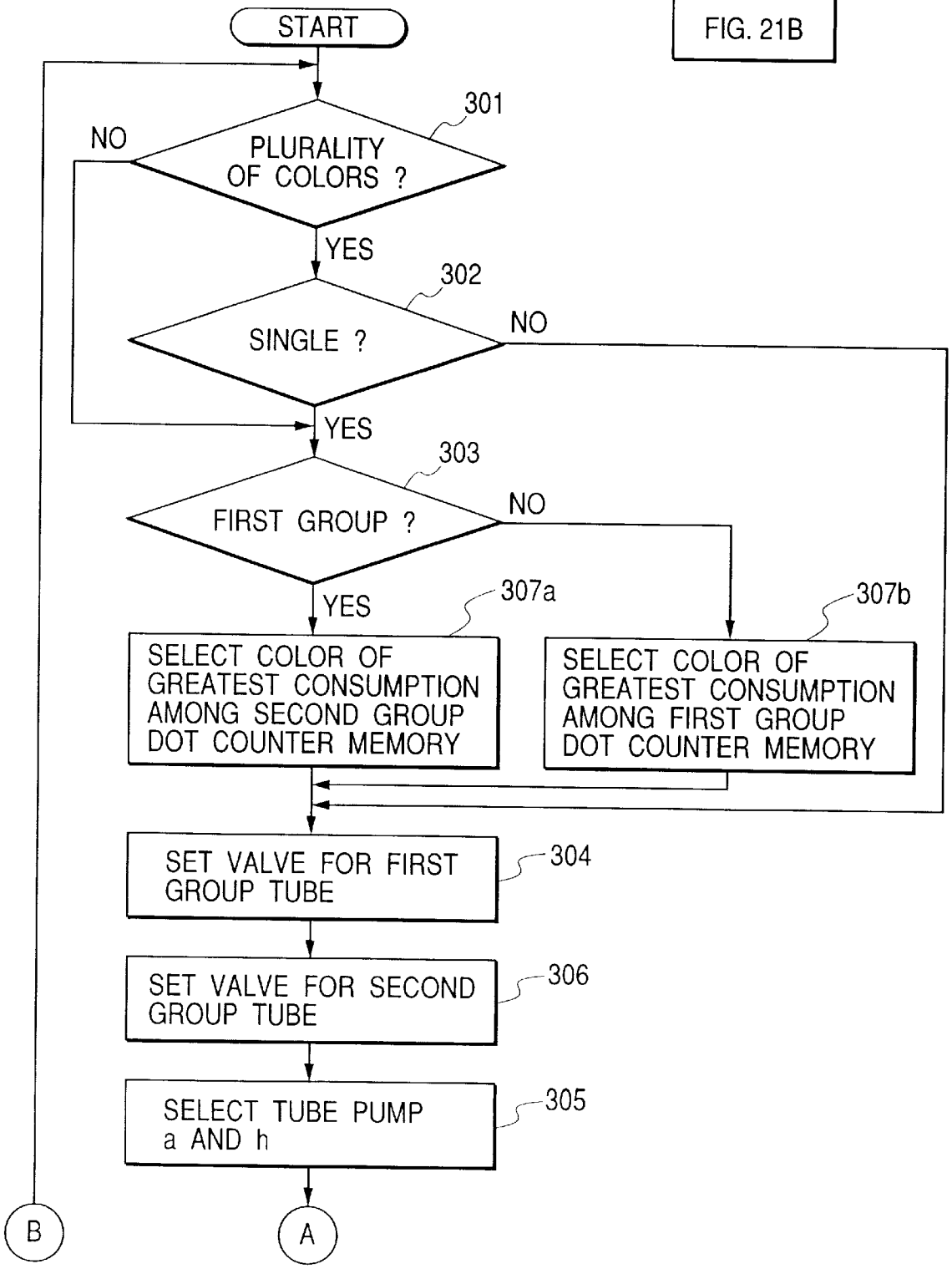
Figure 21B:
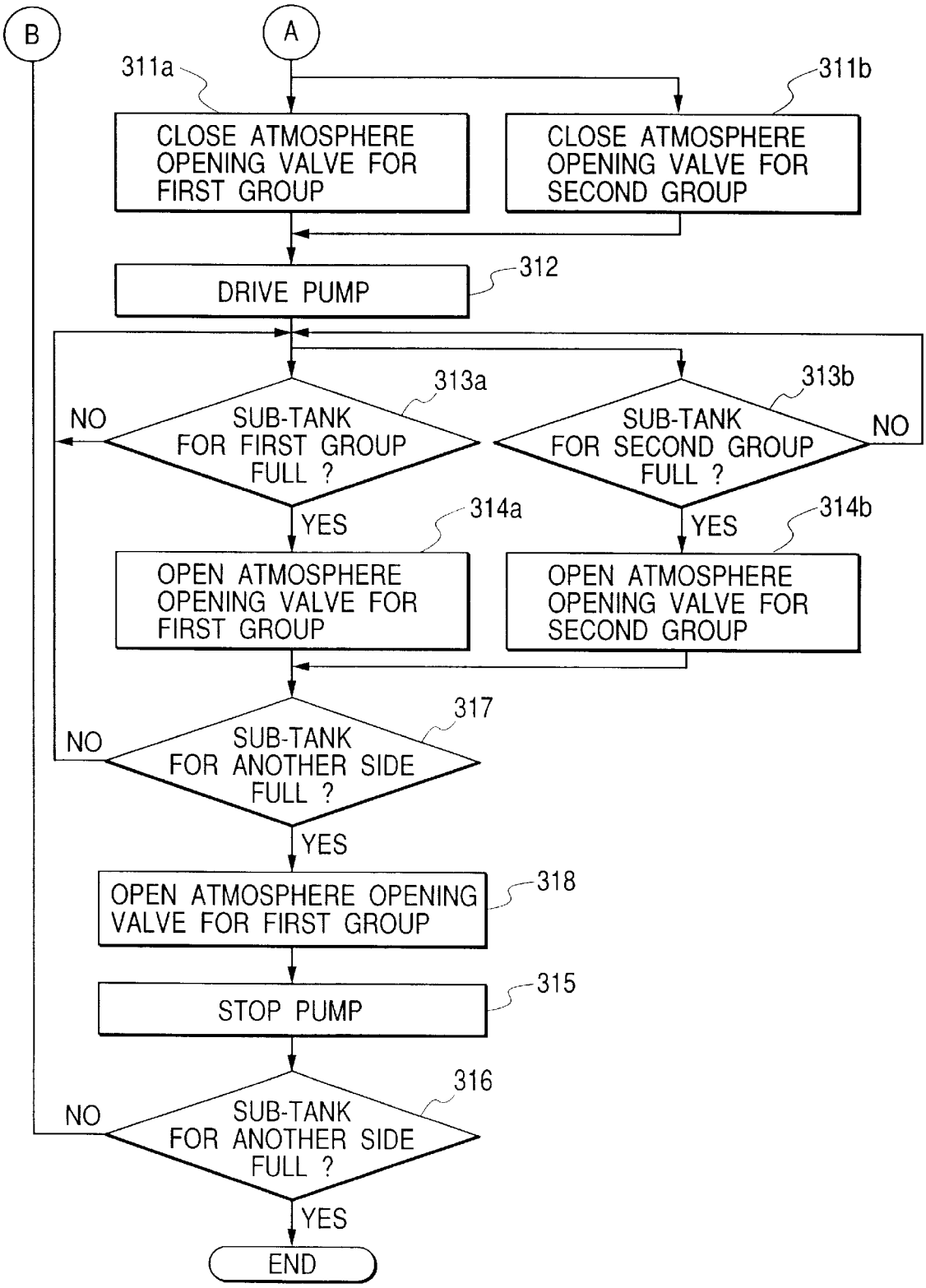

FIG. 20 is a block diagram of the major part of the electric system of the recovery-supply unit of the present embodiment illustrated in FIG. 15 and other figures, and FIGS. 21A and 21B are flowcharts of the replenishing operation of ink to the sub-tanks.

In FIG. 20, CPU 200 is provided for carrying out the ink replenishing operation by controlling the step motor 28, electromagnetic clutch 35 for cap, electromagnetic clutch 70 for selection of pump, electromagnetic clutch 103 for the first group, and electromagnetic clutch 92 for the second group, based on detection results of ink amount detecting sensors 201 provided in the respective sub-tanks, and of ink remainder detecting means 202 for detecting the remainder of ink in the sub-tanks, the ink remainder detecting means being comprised of dot counters for counting shots ejected for printing from the printing heads and a memory for storing counted numbers.

First, the CPU 200 determines whether there are a plurality of colors of the ink liquids to be replenished, based on signals from the respective ink remainder detectors 202 (step 301).

When the ink to be replenished is only one color, the CPU determines whether the sub-tank 12 to be replenished with the ink belongs to the first group 81 or to the second group 82 (step 303). When it belongs to the first group 81, the CPU determines the replenishment to be carried out in combination with a sub-tank 12 with the greatest ink consumption from the signals of the ink detectors of the second group, i.e., in combination with a sub-tank 12 of the liquid supply path having the largest count number in the dot count memory of the second group (step 307*a*). Then the CPU sets the tube valve 80 of the first group 81 and the tube valve 80 of the second group 82 according to the colors of the ink liquids replenished (steps 304, 306) and then selects the tube pump

50*a* (step 305). When the sub-tank 12 to be replenished with the ink belongs to the second group, the CPU also determines a sub-tank for replenishment in combination therewith from the first group in the similar way and sets the valves of the first and second groups, and the tube pumps.

In the present embodiment, the dot count memory is arranged to be capable of storing dot count values for the respective colors of the printing heads and to add up values every ejection of the printing heads 11 to memorize the results. This allows estimation of remaining ink amounts in the respective sub-tanks. After completion of the replenishing operation, the dot counter memory is reset to 0 for the ink supply paths having undergone the replenishment of ink.

On the other hand, if there are a plurality of colors of the ink liquids to be replenished (in the determination of step 301) the CPU selects a combination of two or three replenishing operations.

When both the first group 81 and the second group 82 include a sub-tank to be replenished with the ink, replenishment is carried out at one time in combination thereof (which is determined in step 302). When the sub-tanks requiring replenishment of ink are localized in one group, the operation is similar to the aforementioned operation for replenishment of one color; a sub-tank with the greatest liquid consumption is selected out of the three sub-tanks of the different group (e.g., the second group 82) to be combined (step 307*a* or 307*b*) and concurrent replenishment is carried out.

After setting the tube pumps 50*a*, 50*b* by the above-stated sequence according to the number of sub-tanks requiring replenishment, the CPU closes the atmosphere open valves 24 provided for the sub-tanks 12 to which the liquid is supplied (steps 311*a*, 311*b*) and then drives the tube pumps 50*a*, 50*b* thus selected (step 312). This achieves the replenishment of the ink in the predetermined sub-tanks 12. When the ink amount detector 201 detects that the sub-tank 12 undergoing the replenishment of ink is filled with the ink (step S313*a* or 313*b*), the atmosphere open valve 24 of the full sub-tank is opened (step 314). Since the full sub-tank is opened to the atmosphere at this time, the replenishment of liquid is stopped; but the unfilled sub-tank is still kept in the hermetically closed state and is thus under the replenishment of liquid. When the ink amount detector 201 detects that the other sub-tank under the replenishment is filled with the ink (step 317), the atmosphere open valve 24 thereof is opened (step 318) and the tube pumps 50*a*, 50*b* are stopped (step 315).

This fills one or two sub-tanks 12 with the ink. It is then determined whether there is another sub-tank 12 requiring replenishment of ink (step 316). If there is no sub-tank requiring replenishment then the replenishing operation of ink is terminated. If there is one then the sequential operation described above will be repeated.

As described above, each sub-tank 12 can be independently replenished with the ink by setting each tube valve 80 according to the sub-tank 12 requiring the replenishment of ink, driving the tube pump 50*a*, 50*b*, and matching the operation of the atmosphere open valve of each sub-tank with the detection result of the ink amount detector 201. This obviates the necessity for providing each sub-tank 12 with a negative pressure generator for generating the negative pressure in the sub-tank 12 during the replenishment of ink, which allows decrease in the size of the recovery unit 6 and, in turn, decrease in the size of the overall ink jet recording apparatus.

Further, concurrent ink replenishment can always be performed in combination with the sub-tank with the greatest ink consumption in each group, either the first group or the second group, in any ink replenishing operation, which can increase the efficiency of ink replenishment and which can achieve decrease in the number of ink replenishing operations and decrease in print wait time for ink replenishment.

The above operation will be described in more detail with a specific example for supplying ink liquids of yellow, black, and magenta. As described previously, the sub-tanks of black and magenta belong to the second group 82 while the sub-tank of yellow to the first group 81.

First, the CPU 200 selects concurrent replenishment of black and yellow as the first replenishing operation. Then the CPU 200 performs such control as to set the tube valves 80 of the first group 81 in the yellow replenishment mode. This setting is effected by switching the first-group electromagnetic clutch 103 on, rotating the step motor 28, and setting the angle of rotation of the first-group cams 87 (see FIG. 15) to 90° as in Table 2, based on the detection signal of the first-group sensor 109, as described previously.

Then the CPU 200 performs such control as to set the tube valves 80 of the second group 82 in the black replenishment mode. This setting is effected by switching the second-group electromagnetic clutch 92 on, rotating the step motor 28, and setting the angle of rotation of the second-group cams 86 (see FIG. 14) to 90° as in Table 3, based on the detection signal of the second-group sensor 101, as described previously.

Then the CPU 200 performs such control as to set selection of the both tube pumps 50*a*, 50*b* for replenishment. This setting is accomplished by switching the electromagnetic clutch 70 for selection of pump on, rotating the step motor 28, and setting the angle of rotation of the pump cams 75 (see FIG. 9) to 90° as in Table 1, based on the detection signal of the pump sensor 77, as described previously. Then the atmosphere open valves 24 are closed to bring the sub-tanks 12 of yellow and black into the hermetically closed state.

In this state the CPU 200 performs such control as to drive the tube pumps 50*a*, 50*b*. This establishes the negative pressure in the sub-tanks 12 of yellow and black, whereby the sub-tanks are replenished with the ink from the associated main tanks 13. This driving of the tube pumps 50*a*, 50*b* is carried on until the ink remainder detecting sensors detect that the sub-tanks 12 of yellow and black are filled with the ink. When it is detected, the atmosphere open valves 24 are opened and the tube pumps 50*a*, 50*b* are stopped. The above completes the first replenishment operation.

After completion of the first replenishment operation, the CPU 200 determines whether the second replenishment operation should be carried out. Since there still remains the replenishment of the ink of cyan at this point, the CPU returns to the initial step. Since the sub-tank 12 storing the ink of cyan belongs to the first group 81, the CPU 200 determines that the replenishment is to be carried out in combination with a sub-tank 12 of a liquid supply path having the largest count number in the dot count memory out of the three ink supply paths of the second group (step 307*a*).

Since the replenishment of the yellow ink is already done, a candidate for the combination herein is light magenta or light cyan. After the combination for concurrent replenishment is determined, the operation to follow is carried out in the similar manner to the first replenishment operation; the atmosphere open valves 24 are closed to drive the tube pumps 50*a*, 50*b*, the sub-tanks 12 of the ink of cyan and the other color to be simultaneously replenished with cyan are filled with the ink, and then the atmosphere open valves 24 are closed to stop the tube pumps 50*a,* 50*b.* This completes the replenishment operation of all the ink.

In the application of color print using the ink liquids of black, cyan, magenta, yellow, light magenta, and light cyan like the present embodiment, consumptions of the black ink and the yellow ink are normally larger than those of the ink of the other colors. Thus black and yellow often have to be replenished on the almost same timing. Therefore, black and yellow are preferably grouped into the different groups as in the present embodiment, whereby the both can be replenished at one time even with coincidence of replenishment timing of black and yellow, so that the ink can be replenished more effectively. In the case where ink liquids with more consumptions are preliminarily determined as described, they are preferably assigned to mutually different groups.

In the present embodiment the six sub-tanks 12 are grouped into the two groups and each group is provided with the tube pump 50*a* or 50*b* being the negative pressure generating means; but the sub-tanks 12 do not always have to be grouped in the two groups. The apparatus may be modified so that an appropriate number of negative pressure generators are provided within the scope smaller than the number of liquid supply paths including the sub-tanks and groups are provided in the number equal to the number of negative pressure generators. Since the concurrent replenishment of plural ink liquids is not possible with only one negative pressure generator, it is necessary to provide two or more negative pressure generators in order to achieve more efficient ink replenishment. The optimum number of negative pressure generators (i.e., the number of groups) is preferably designed in view of the permissible volume and ink replenishment efficiency of the ink jet recording apparatus.

The numbers of liquid supply paths belonging to the respective groups do not always have to be equal. For example, in the case where ink liquids of six different kinds are used like the present embodiment or where liquids used are ink liquids and treatment liquids to react with the ink liquids, if the consumption of one kind among them is extremely large, only the liquid supply path for supplying the liquid of that kind may be handled as a single group.

In the above embodiment the ink replenishment into each sub-tank has to be carried out in the period in which the printing operation is not performed. Next described referring to FIG. 22 and FIG. 23 is a modification in which the structure of the sub-tanks is modified in order to decrease the stop time.

Figure 22:
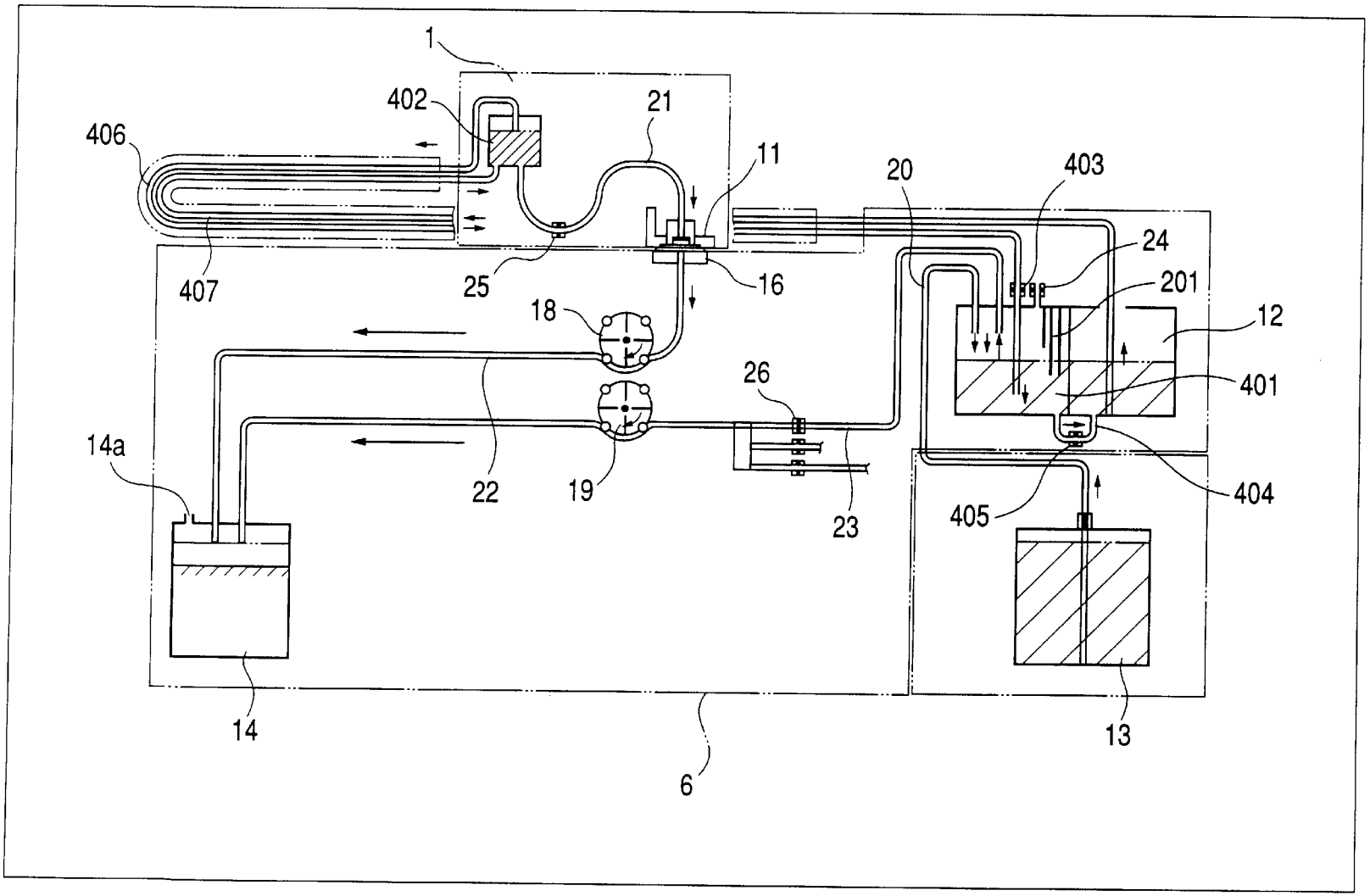
FIG. 22 is a drawing for explaining ink lines in a modification of the liquid supplying apparatus of the present invention.
Figure 23:
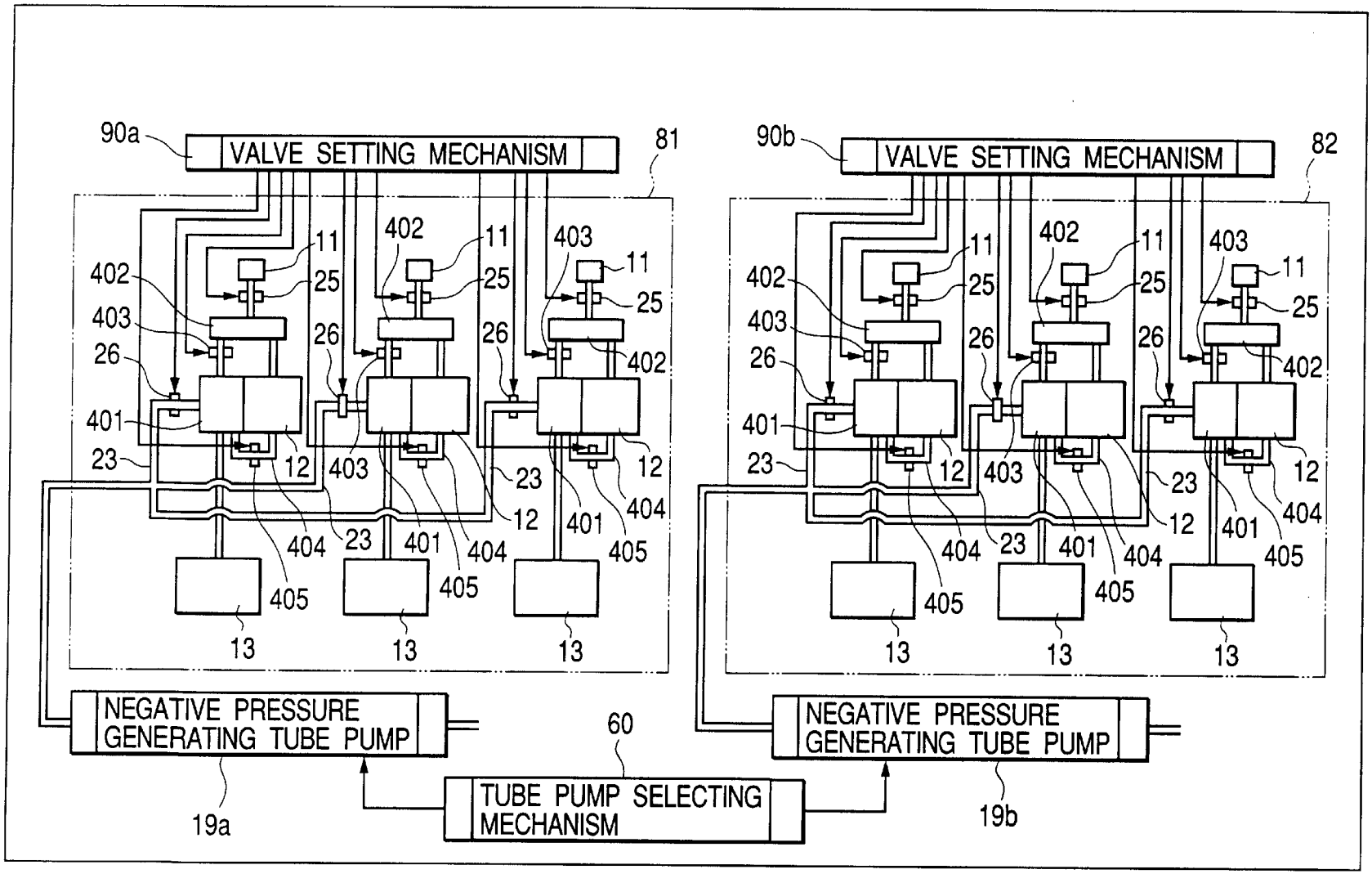
FIG. 23 is a schematic block diagram of the part involved in replenishment of ink into the sub-tanks in the ink jet recording apparatus shown in FIG. 22.

FIG. 22 is an explanatory drawing to show the modification of the ink supply paths of the present invention and FIG. 23 is a schematic block diagram of the part involved in the ink replenishment into the sub-tanks in the modification. The present modification is different from the above embodiment in that the ink replenishment can also be performed during printing. When combined with the liquid supplying method of the present invention, the present modification can improve the efficiency of ink replenishment more.

In the following description elements having similar functions to those in the above embodiment will be denoted by the same reference symbols and the description thereof will be omitted.

First described is the flow of the ink in the modification of the present invention.

In FIG. 22, a hermetically closed tank 401 is replenished with the ink from the main tank 13 through the tank tube 20. After that, the sub-tank 12 is replenished with the ink from the hermetically closed tank 401 through a CS tube 404. Then the ink is supplied to air buffer 402 through closed-tank tube 406 from the hermetically closed tank 401 and through sub-tank tube 407 from the sub-tank 12.

The ink is supplied from the air buffer 402 through head tube 21 to the printing head 11.

The flow of the ink will be described in further detail referring to FIG. 22.

First described is the supply of the ink to the hermetically closed tank 401.

The atmosphere open valve 24, AC tube closing valve 403, and CS tube closing valve 405 are actuated to hermetically close the inside of the hermetically closed tank 401. Then the negative pressure generating tube pump 19 is driven to establish the negative pressure inside the hermetically closed tank 401, whereby the ink inside the main tank 13 is supplied through the tank tube 20 into the hermetically closed tank 401.

When the ink remainder detecting sensor 201 detects "full" as a result of the ink replenishing operation from the main tank 2 to the hermetically closed tank 401, the atmosphere open valve 24 is opened to make the hermetically closed tank 401 open to the atmosphere and then to stop the flow of ink. After that, an instruction to stop the negative pressure generating tube pump 19 is issued, so that the pump 19 is stopped. The other end of the negative pressure generating tube pump 19 is put in the waste ink tank 14.

Then the AC tube closing valve 403 and CS tube closing valve 405 are opened, whereupon the ink inside the hermetically closed tank 401 moves through the CS tube 404 into the sub-tank 12 because of the weight of the ink itself. Then the ink inside the hermetically closed tank 401 flows into the sub-tank 12 before the height of the ink inside the hermetically closed tank 401 becomes equal to that of the ink inside the sub-tank 12.

If air (bubbles) is mixed in the ink in the CS tube 404, the ink will be hard to flow or will not be allowed to flow in the CS tube 404 in some cases.

In such cases, the atmosphere open valve 24 and AC tube closing valve 403 are closed and thereafter the negative pressure generating tube pump 19 is driven in the counter-clockwise direction, whereby positive pressure is established in the hermetically closed tank 401 to push the ink in the hermetically closed tank 401 into the CS tube 404. This pushes the air (bubbles) from the CS tube 404 into the sub-tank 12. After that, the negative pressure generating pump 19 is stopped and the atmosphere open valve 24 and AC tube closing valve 403 are opened. As a consequence, the inside of the CS tube 404 is filled with the ink, so that the ink in the hermetically closed tank 401 can flow through the CS tube 404 into the sub-tank 12 before the height of the ink in the hermetically closed tank 401 becomes equal to that of the ink in the sub-tank 12. The sub-tank 12 has an open-to-atmosphere aperture, through which the sub-tank 12 is open to the atmosphere. Therefore, the air (bubbles) pushed into the sub-tank 12 can be released through the open-to-atmosphere aperture into the atmosphere, so that the inside of the sub-tank 12 is kept at the atmospheric pressure.

After the height of the ink in the hermetically closed tank 401 becomes equal to that of the ink in the sub-tank 12 and when the ink remainder detecting sensor 201 in the hermetically closed tank 401 detects "empty" of the height of the ink in the hermetically closed tank 401, the ink replenishing operation into the hermetically closed tank 401 is again carried out.

With repetitions of the above ink replenishing operation, the heights of the ink in the hermetically closed tank 401 and in the sub-tank 12 are maintained between the full-line and the empty-line of the ink remainder detecting sensor 201.

Next described is the ink supply operation from the sub-tank 12 to the air buffer 402.

First, the atmosphere open valve 24, CS tube closing valve 405, and head tube closing valve 25 are closed. After that, the negative pressure generating tube pump 19 is driven, whereupon the negative pressure is established in the hermetically closed tank 401. Then the negative pressure is also established in the closed-tank tube 406, so that the negative pressure is established in the air buffer 402 and in the sub-tank tube 407 as well.

This results in supplying the ink in the sub-tank 12 through the sub-tank tube 407 into the air buffer 402 and thereafter supplying the ink through the closed-tank tube 406 into the hermetically closed tank 401.

Since the negative pressure is also established in the tank tube 20 at this time, the ink is also supplied from the main tank 13 to the hermetically closed tank 401. Then the negative pressure generating tube pump 19 is stopped.

After that, the atmosphere open valve 24 and CS tube closing valve 405 are opened.

Since the passage resistance against the flow of the ink through the sub-tank tube 407, air buffer 402, and closed-tank tube 406 is arranged to be smaller than that against the flow of the ink in the tank tube 20, the ink can be supplied to the air buffer 402 with reliability.

Next described is the ink supply operation from the air buffer 402 to the printing head 11.

First, the printing head 11 is capped by the cap 16. Then the recovery tube pump 18 is driven, whereupon the negative pressure is established in the cap 16 connected through the tube to the recovery tube pump 18. This results in supplying the ink in the air buffer 401 through the head tube 21 to the printing head 11 and then filling the nozzles in the printing head 11 with the ink. Thereafter, the recovery tube pump 18 is stopped and then the cap 16 is uncapped. At this time a meniscus is created in the nozzles in the printing head 11, so that the ink can be held even with a difference between the nozzle face of the printing head 11 and the height of the ink in the hermetically closed tank 401 and the sub-tank 12. The ink drawn into the cap 16 is guided through the suction tube 22 into the waste ink tank 14.

The ink can be ejected from the printing head 11 by charging the ink into the ink path illustrated in FIG. 22, in this way.

When the ink is discharged from the printing head 11 by the printing operation or the recovery suction operation of the printing head 11, the ink flows from the sub-tank 12 to the printing head 11 because of the capillarity, whereby the meniscus is always maintained in the nozzles of the printing head 11. Then the liquid level is lowered in the sub-tank 12 and the weight of the ink acts to keep the liquid levels equal in the sub-tank 12 and in the hermetically closed tank 401. Thus, the ink is supplied from the hermetically closed tank 401 to the sub-tank 12.

When the ink is consumed because of printing or the like, the ink remainder detecting sensor 201 of the hermetically closed tank 401 detects "empty" and the ink replenishing operation is carried out.

This ink replenishing operation is similar to the operation described in the aforementioned embodiment.

In the modification, the ink is supplied to the hermetically closed tank 401, instead of the sub-tank 12 of the aforementioned embodiment, and the hermetically closed tank 401 is hermetically closed without closing the head tube closing valve 25, but, instead, with closing the AC tube closing valve and CS tube closing valve 405. Therefore, the ink replenishing operation can be performed wherever the carriage 1 is located. The ink can be supplied to the printing head 11 because of the action of the sub-tank 12, and thus the ink replenishment can be conducted even during printing.

As described in the aforementioned embodiment, sets of sub-tanks 12, hermetically closed tanks 401, and main tanks 13 (also including the tubes connected thereto) are grouped into the first group and the second group, each group is provided with the negative pressure generator, and the ink consumption of each hermetically closed tank 401 (sub-tank 12) is managed by the dot counter for each printing head 11, and the memory; therefore, a combination of tanks with the greatest ink consumptions in the respective groups can always be replenished with the ink on the concurrent basis.

The ink replenishing operation to the hermetically closed tank 401 will be described below.

The operation of the tube valve is the same as in the aforementioned embodiment.

Reference is made to the flowchart of operation and the block diagram of the aforementioned embodiment, which are the same in the present modification.

When the ink to be replenished is of one color, it is determined whether the hermetically closed tank 401 to be replenished with the ink belongs to the first group 81 or to the second group 82 (step 303). When it belongs to the first group 81, the CPU 200 invokes the contents of the dot count memory about the three hermetically closed tanks 401 of the other group (the second group 82) and chooses a hermetically closed tank 401 with the greatest consumption among them as a counterpart of a combination (step 307*a*) to determine replenishment thereof. Then the tube valves 80 of the first group 81 and the tube valves 80 of the second group 82 are set according to the colors of the ink liquids to be replenished (step 304 and step 306) and the tube pumps 50*a*, 50*b* are selected (step 305).

In the case of the second group 82, the CPU also invokes the contents of the dot count memory about the three hermetically closed tanks 401 of the other group (the first group 81) and selects one hermetically closed tank 401 with the greatest consumption among them as a counterpart of a combination (step 307*b*) to determine replenishment thereof. Then the tube valves 80 of the first group 81 and the tube valves 80 of the second group 82 are set according to the colors of the ink liquids to be replenished (step 304 and step 306) and the tube pumps 50*a*, 50*b* are selected (step 305).

The dot count memory, similar to that in the aforementioned embodiment, can capture the consumption of the ink of each color and can estimate the remaining ink amount in each hermetically closed tank 401. The dot count memory is reset to zero after completion of the ink replenishment.

On the other hand, when there are a plurality of ink liquids to be replenished (in the determination in step 301), replenishment is effected by a combination of two or three replenishment operations.

When the first group 81 and the second group 82 both includes the ink to be replenished at this time, the concurrent replenishment is carried out in combination of the ink liquids to be replenished (in the determination in step 302). When only either one group includes the ink to be replenished, the CPU invokes the contents of the dot count memory about the three hermetically closed tanks 401 of the other group (the second group 82), chooses one hermetically closed tank 401 with the greatest consumption among them as a counterpart of a combination (steps 307*a,* 307*b*), as described in the case of one color of the ink to be replenished, and then performs concurrent replenishment. As described, the hermetically closed tanks 401 with the greatest ink consumptions in the respective groups of the first group 81 and the second group 82 can always be replenished on the concurrent basis in any ink replenishing operation, which improves the efficiency of ink replenishment.

Then the tube pumps 50*a,* 50*b* are set and the atmosphere open valves 24 provided for the hermetically closed tanks 401 are next closed (step 311*a* and step 311*b*). Then the tube pumps 50*a,* 50*b* are driven (step 312). This replenishes the predetermined hermetically closed tanks 401 with the ink. When the ink remainder detecting sensor 201 detects that the corresponding, hermetically closed tank 401 replenished with the ink is filled with the ink (step 313*a* or 313*b*), the atmosphere open valve 24 of the filled, hermetically closed tank 401 is opened (step 314*a* or 314*b*). This results in opening the hermetically closed tank 401 to the atmosphere, so that the negative pressure disappears to stop the replenishment of ink, irrespective of driving of the tube pump 50*a* or 50*b* (in this state the atmosphere open valve 24 of the hermetically closed tank 401 is still closed on the side without detection of the ink remainder detecting sensor 201, and the ink replenishment is on the way on that side). When the ink remainder detecting sensor 201 detects that the hermetically closed tank 401 on the other side is also filled with the ink (step 317), the atmosphere open valve 24 thereof is opened (step 318) and the tube pump 50*a* or 50*b* is stopped (step 315). Then the CS tube closing valve 405 and AC tube closing valve 403 are opened, whereupon the ink is supplied through the CS tube 404 into the sub-tank 12 because of the weight of the ink itself.

This fills one or two sub-tanks 12 with the ink. Then the CPU determines whether there is another hermetically closed tank 401 necessitating replenishment of ink (step 316). If no then the replenishment operation of ink is terminated; if any then the sequential operation described above is repeated.

Each tube valve 80 is set and each tube pump 50*a,* 50*b* is driven according to the hermetically closed tank 401 (sub-tank 12) necessitating the replenishment of ink and the operation of the atmosphere open valve 24 of each sub-tank 12 is timed with the ink remainder detecting sensor 201, as described above, whereby each hermetically closed tank 401 (sub-tank 12) can be replenished with the ink independently. As a consequence, the recovery-supply unit 6 can be provided without the necessity for provision of the negative pressure generator for generating the negative pressure in the hermetically closed tank 401 during the replenishment of ink for every hermetically closed tank 401, and, even in any ink replenishing operation, the concurrent replenishment can always be performed for the hermetically closed tanks 401 (sub-tanks 12) with the greatest ink consumptions in the respective groups of the first group 81 and the second group 82, which can improve the efficiency of ink replenishment and which can decrease the number of ink replenishing operations.

Even in the case of the above ink path configuration capable of ink replenishment during printing, the decrease in the number of ink replenishing operations presents the advantages of saving of power and decrease of abrasion of parts.

As described above, the present invention permits downsizing of the whole apparatus by the structure in which a plurality of liquid supply paths share one negative pressure generator and also permits the concurrent charge of liquids to the respective liquid supply paths having the sub-tanks with the greatest liquid consumptions in the respective groups separated according to the number of negative pressure generators during replenishment of liquid, whereby the invention can improve the efficiency of liquid replenishment and decrease the number of ink replenishing operations and, in turn, can decrease the time of stop of the apparatus for the ink replenishment.

For replenishing a sub-tank with a liquid, the sub-tank is hermetically closed to the atmosphere and is depressurized by use of the negative pressure generator provided for a path different from the liquid supply path, whereby the liquid is supplied from the upstream side of the liquid supply path into the sub-tank. This can implement stable replenishment of liquid as well as the simple structure of the liquid supply path.

The embodiments described above employed detection of the remainder by use of the dot counters for detecting the remainder of liquid in the sub-tanks, but the method for detecting the remainder is not limited to this method. For example, the remainder can also be detecting by use of one of well-known configurations, such as provision of electrodes in the sub-tanks.

Further, the present invention was described with the examples of the ink jet recording apparatus in the above-stated embodiments, but it should be noted that the present invention can not be applied only to the ink jet recording apparatus but can also be applied to other applications, including supply of liquid to a liquid consuming member except for the recording head. In addition, the applicable liquids are not limited only to the ink and pretreatment solutions and the liquids may be oily liquids. Particularly, the invention is suitably applicable to supply of a liquid that is desired to avoid mixture of contamination in the supply path.

What is claimed is:

1. A liquid replenishing method into a liquid supply mechanism, said liquid supply mechanism comprising three or more liquid supply paths, each liquid supply path having a sub-tank for temporarily retaining a liquid and for supplying said liquid by guiding atmospheric air thereinto, said replenishing method comprising:

a preparing step to prepare a plurality of negative pressure generating means, each for depressurizing an inside of one of said sub-tanks, the number of negative pressure generating means being smaller than the number of said liquid supply paths, and to group said plurality of liquid supply paths into groups according to said number of said negative pressure generating means, an establishing step to establish a hermetically closed space in a sub-tank with a smallest remaining liquid in each group, and a replenishing step to replenish liquid, the liquid being replenished commencing simultaneously in each said sub-tank with a smallest remaining liquid in each group, and being replenished commencing simultaneously by depressurizing the insides of each hermetically closed space using said negative pressure generating means associated with each group.

2. The liquid replenishing method according to claim 1, wherein said replenishing step is carried out when the remainder of the liquid in at least one sub-tank out of the sub-tanks provided in said plurality of liquid supply paths falls below a predetermined amount.

3. The liquid replenishing method according to claim 1, wherein, after said replenishing step, the sub-tank having been replenished is opened to atmospheric air.

4. The liquid replenishing method according to claim 1, wherein depressurizing the inside of each hermetically closed space by said negative pressure generating means is achieved in such a manner that each negative pressure generating means evacuates atmospheric air inside the sub-tank corresponding thereto.

5. The liquid replenishing method according to claim 1, wherein two liquid supply paths with large liquid consumptions out of said plurality of liquid supply paths are grouped into mutually different groups.

6. A liquid ejection recording apparatus capable of ejecting liquids of mutually different kinds, said apparatus comprising:

at least three liquid supply paths, each liquid supply path comprising a liquid ejection head for ejecting a liquid to effect recording, a main tank for reserving the liquid to be supplied to said liquid ejection head, and a sub-tank, provided between said liquid ejection head and the main tank, for temporarily retaining the liquid and for supplying the liquid to said liquid ejection head by guiding atmospheric air thereinto, and a plurality of negative pressure generating means, each for depressurizing an inside of one of said sub-tanks in order to replenish the liquid from said main tank into said sub-tank, the number of said negative pressure generating means being smaller than the number of said liquid supply paths, wherein said liquid supply paths are grouped into groups according to said number of said negative pressure generating means, wherein each of said plurality of liquid supply paths comprises hermetically closing means for establishing a hermetically closed space in said sub-tank, and wherein out of said sub-tanks, a sub-tank with a smallest remaining liquid in each group is depressurized by said negative pressure generating means and said closing means associated therewith, and the liquid is replenished commencing simultaneously to each depressurized sub-tank.

7. The liquid ejection recording apparatus according to claim 6, wherein two liquid supply paths with large consumptions, out of said plurality of liquid supply paths, are grouped into mutually different groups.

8. The liquid ejection recording apparatus according to claim 6, wherein each of said plurality of negative pressure generating means is provided in a path different from the liquid supply paths in a corresponding group.

9. The liquid ejection recording apparatus according to claim 6, wherein each of said plurality of negative pressure generating means is comprised of a pump capable of evacuating air in a sub-tank provided in a liquid supply path in a corresponding group.

10. The liquid ejection recording apparatus according to claim 9, wherein each of said negative pressure generating means is comprised of a tube pump, said tube pump comprising a tube pump provided in a tube connected to a sub-tank in a corresponding liquid supply path out of the liquid-supply paths grouped according to the number of negative pressure generating means, a tube receiver for receiving said pump tube, a roller member adapted so as to pinch said pump tube in cooperation with said tube receiver and to be movable along said pump tube thereon, and a tube receiver energizing member for energizing said tube receiver toward said roller member.

11. The liquid ejection recording apparatus according to claim 6, wherein each of said plurality of liquid supply paths comprises detecting means for detecting whether the remainder of the liquid in the corresponding sub-tank is not more than a predetermined amount.

12. The liquid ejection recording apparatus according to claim 11, wherein said detecting means comprises a dot counter for counting shots ejected for printing from each said liquid ejection head and a memory for storing the number of shots.

13. The liquid ejection recording apparatus according to claim 6, wherein each liquid supply path from said sub-tank to said recording head is comprised of a tube, and wherein said hermetically closing means is comprised of a tube valve, said tube valve comprising a tube pressing member elastically supported so as to be capable of pressing said tube, a tube valve lever provided so as to be movable toward said tube pressing member, and a lever energizing member for energizing said tube valve lever toward said tube pressing member, said tube valve being adapted to flatten said tube from outside said tube to close a flow path in said tube.

14. The liquid ejection recording apparatus according to claim 13, comprising valve setting means having a tube valve cam mechanism for moving said tube valve lever against an energizing force of said lever energizing member.

15. The liquid ejection recording apparatus according to claim 6, wherein each said sub-tank comprises a first chamber in fluid communication with a corresponding main tank and with the negative pressure generating means, said first chamber being replenished with the liquid from the main tank, a second chamber in fluid communication through a communication path with said first chamber and in fluid communication with said recording head, said second chamber supplying the liquid to said recording head by guiding atmospheric air thereinto, and path closing means for closing said communication path.

* * * * *

UNITED STATES PATENT AND TRADEMARK OFFICE

CERTIFICATE OF CORRECTION

PATENT NO. : 6,168,268 B1
DATED : January 2, 2001
INVENTOR(S) : Toshiro Sugiyama It is certified that error appears in the above-identified patent and that said Letters Patent is hereby corrected as shown below:

Title page,
Under "References Cited", please add the following citations:

-- U.S. PATENT DOCUMENTS

| | | |
|---|---|---|
| 5,828,389 | 10/27/98 | Yamaguchi, et al |
| 5,751,300 | 5/12/98 | Cowger, et al |
| 4,492,969 | 1/8/85 | Terasawa |

-- FOREIGN PATENT DOCUMENTS

| | | |
|---|---|---|
| 803,362 | 10/29/97 | Europe -- |

Column 4,
Line 60, change "not illustrated" to -- (not illustrated). --

Column 5,
Line 24, change "mechanisms" to -- mechanisms, --.

Column 7,
Line 22, change "not illustrated" to -- (not illustrated).--

Column 11,
Line 3, change the first occurrence of "pump" to -- pumps --; and
Line 35, change "pump" to -- pumps --.

Column 16,
Line 20, change "ink" to -- ink, --; and
Line 29, change "above described the" to -- above-described --.

Column 17,
Line 56, change "pump" to -- pumps --.

Column 18,
Line 30, change "the both" to -- both --.

Column 19,
Line 11, change "the both" to -- both --.

UNITED STATES PATENT AND TRADEMARK OFFICE

CERTIFICATE OF CORRECTION

PATENT NO. : 6,168,268 B1
DATED : January 2, 2001
INVENTOR(S) : Toshiro Sugiyama It is certified that error appears in the above-identified patent and that said Letters Patent is hereby corrected as shown below:

Column 23,
Line 38, change "no" to -- no, --; and
Line 39, change "any" to -- any, --.

Column 24,
Line 22, change "detecting" to -- detected --; and
Line 29, change "can not" to -- cannot --.

Signed and Sealed this

Twenty-third Day of July, 2002

*Attest:*

*Attesting Officer*

JAMES E. ROGAN
*Director of the United States Patent and Trademark Office*